US005694867A

United States Patent [19]

Diaz-Lopez

[11] Patent Number: 5,694,867

[45] Date of Patent: Dec. 9, 1997

[54] FAIL-SAFE ACCESS CONTROL CHAMBER SECURITY SYSTEM

[76] Inventor: William Diaz-Lopez, P.O. Box 1081, St. Just, Puerto Rico, 00978

[21] Appl. No.: 718,023

[22] Filed: Sep. 23, 1996

Related U.S. Application Data

[63] Continuation of Ser. No. 255,488, Jun. 8, 1994, abandoned.

[51] Int. Cl.[6] ..... E05G 5/02

[52] U.S. Cl. ..... 109/6; 49/68; 109/7; 109/68

[58] Field of Search ..... 109/2–9, 11–18, 109/67, 68; 49/68, 25

[56] References Cited

U.S. PATENT DOCUMENTS

| | | | |
|---|---|---|---|
| 3,174,193 | 3/1965 | Smith . | |
| 3,669,038 | 6/1972 | Watson | 109/12 |
| 3,924,546 | 12/1975 | Pretini | 109/3 |
| 3,965,827 | 6/1976 | Reeves | 109/3 |
| 4,011,686 | 3/1977 | Jett, III et al. | 49/68 |
| 4,060,039 | 11/1977 | Lagarrigue | 109/3 |
| 4,122,783 | 10/1978 | Pretini | 109/3 |
| 4,308,803 | 1/1982 | Pretini | 109/3 |
| 4,375,735 | 3/1983 | Rhoads | 49/68 |
| 4,461,221 | 7/1984 | Schandle et al. | 109/6 |
| 4,481,887 | 11/1984 | Urbano | 109/3 |
| 4,516,114 | 5/1985 | Cook | 340/542 |
| 4,586,441 | 5/1986 | Zekich | 109/8 |
| 4,598,495 | 7/1986 | Labarile | 49/41 |
| 4,656,954 | 4/1987 | Tonali | 109/6 |
| 4,682,801 | 7/1987 | Cook et al. | 292/251.5 |
| 4,741,275 | 5/1988 | Lewiner et al. | 109/7 |
| 4,871,204 | 10/1989 | Cook et al. | 292/251.5 |
| 5,195,448 | 3/1993 | Sims | 109/6 |
| 5,311,166 | 5/1994 | Frye | 340/541 |

FOREIGN PATENT DOCUMENTS

| | | | |
|---|---|---|---|
| 0268924 | 6/1988 | European Pat. Off. | 109/3 |

*Primary Examiner*—Lloyd A. Gall
*Attorney, Agent, or Firm*—John Ryznic

[57] ABSTRACT

A fail-safe access control chamber security system (ACCSS) including a bullet-proof access control unit (ACU) having an entrance chamber and an exit chamber. The entrance chamber includes a first interlocking door providing passage from a non-secure area into the entrance chamber and a second interlocking door providing passage from the entrance chamber to a secure area. The entrance chamber includes a first floor mat and a second floor mat located between the first and second doors to determine the location of a person within the entrance chamber. A metal detector is provided between the first and second floor mats and the system includes arrangements for preventing entrance into the secure area if a weapon is present. Control circuitry prevents the simultaneous opening of the first and second doors. The exit chamber includes a third interlocking door for providing passage from the secure area into the exit chamber and a fourth interlocking door providing passage from the exit chamber to the non-secure area. A third floor mat located between the third and fourth doors determines the location of a person within the exit chamber. The system includes arrangements for preventing the simultaneous opening of the third and fourth doors.

32 Claims, 14 Drawing Sheets

FIG. 6a
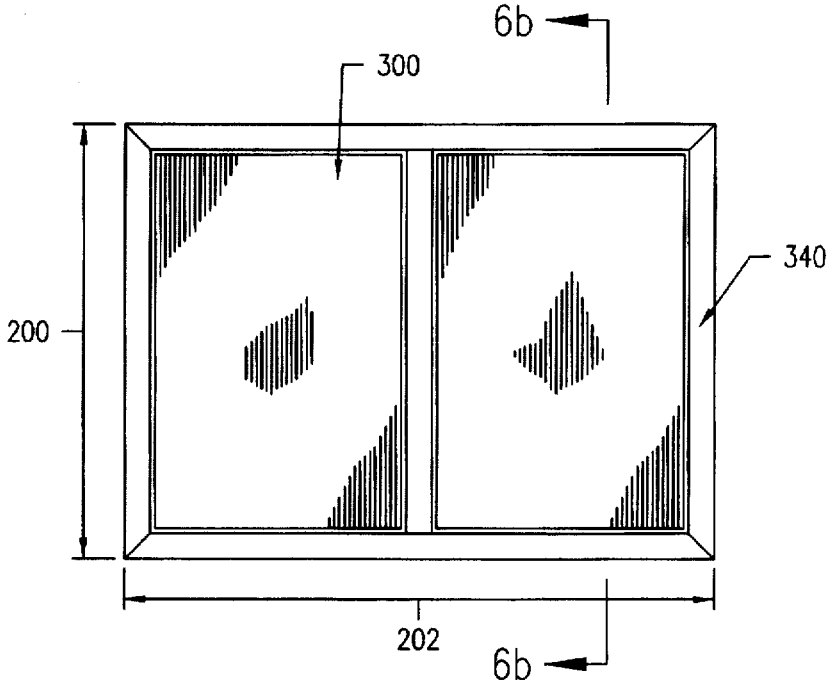
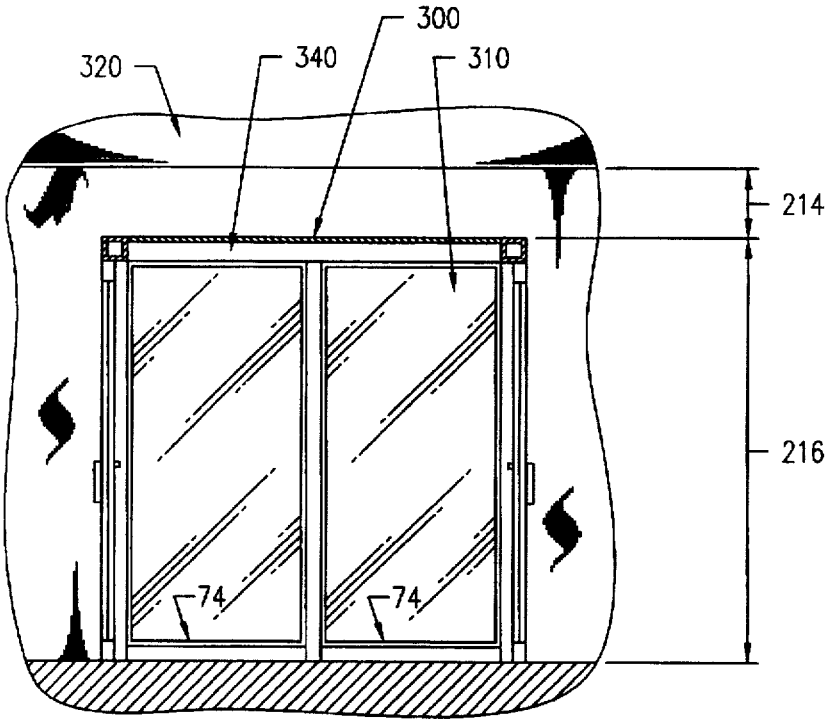
FIG. 6b

FIG. 6c
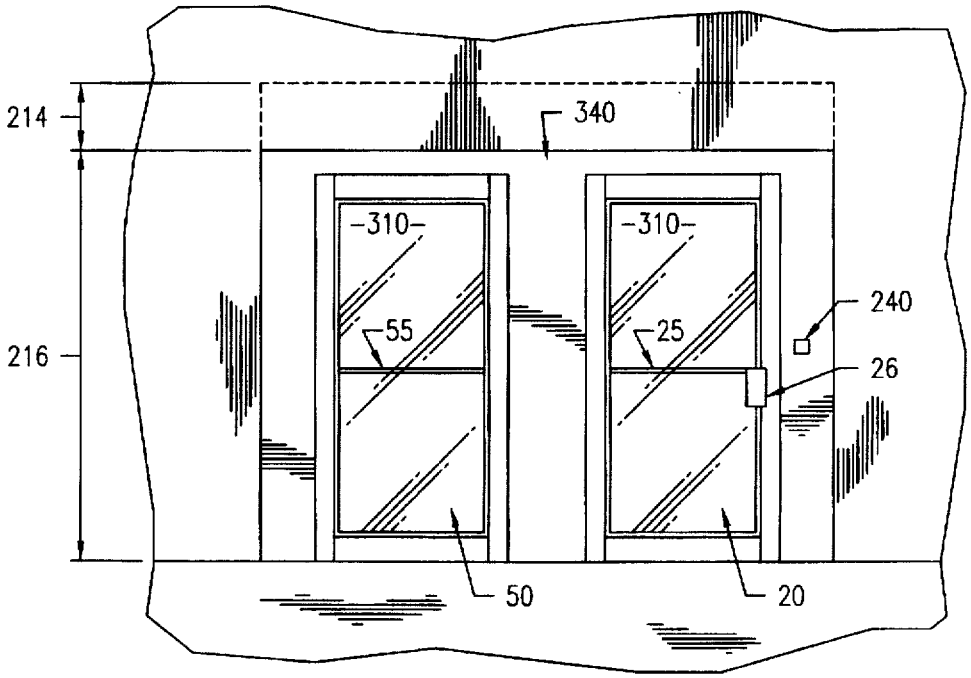
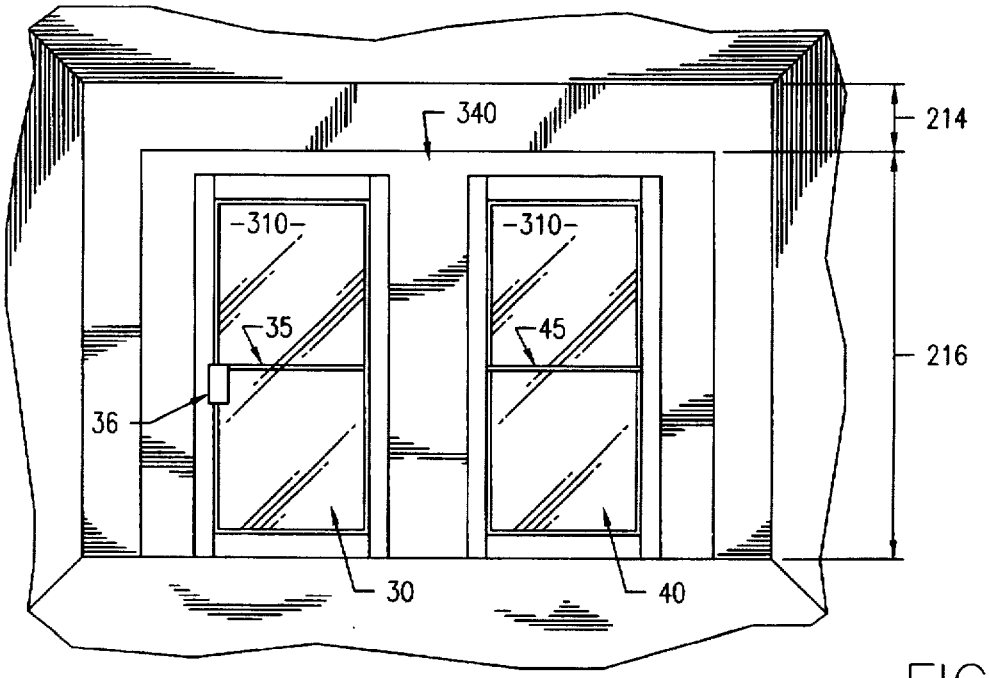
FIG. 6d

FAIL-SAFE ACCESS CONTROL CHAMBER SECURITY SYSTEM

This application is a continuation of Ser. No. 255,488, filed on Jun. 8, 1994, now abandoned.

FIELD OF THE INVENTION

This invention relates to security access systems for banks or the like which satisfy fire department regulations, handicapped regulations, and which also meets the needs of the bank for reasonably rapid access and the prevention of robberies. The system makes use of multiple security doors which lock to prevent more than one door from opening at a time, and to prevent the inner-most door from opening when a weapon such as a gun is detected by a metal detector.

BACKGROUND OF THE INVENTION

Bankers' Hotline (Vol. IV, No. 9, Page 5) included the following statistics about bank robberies from a Special Agent from the federal Bureau of Investigation: the typical bank robber is now a white male under the age of 30—more often under age 25; thirty five percent of all bank robberies now involve guns—most of the rest are written note passing incidents; there were 150 reported robberies in 1930, there were 450 in 1960, and approximately 10,000 each in 1990, 1991, and 1992, there were 393 acts of violence, 18 died, 118 were taken hostage; in greater Los Angeles area, where 25% of all bank robberies take place, there were recorded in 1991, 4 robberies involving shots being fired, and 5 assaults; and in 1992, Los Angeles had 43 robberies involving shots, and 64 assaults.

These statistics indicate the need for sophisticated security precautions for banks, such as access control chambers systems. Some common access control security systems are suggested in U.S. Pat. No. 5,195,448, to Sims U.S. Pat. No. 4,656,954 to Tonali, and U.S. Pat. No. 4,481,887 to Urbano. These and other common access control chamber systems, have significant problems which allow criminals who plan around the system to enter the secured building with a weapon.

In one example of a method a criminal could use to evade a common access control chamber system, a would -be bank robber can open the outer entry door and throw a weapon between the metal detector panels without activating the unit, proceed to the second entry door, pick up the weapon and enter the bank. Another means of evading a common access control chamber systems uses two bank robbers who enter the outer entry door together. The first robber, who has no weapon, then proceeds to the second entry door while the second robber, who has a hidden weapon, straddles the entryway putting his feet on the metal framing, waits for the first robber to open the second entry door, and then both enter the bank. In yet another method of evading a common access control chamber system, a would-be bank robber would proceed inside the entry chamber, activate the metal detector, drop his weapon on the floor, exit the chamber through first entry door, wait for operator to reset the system, and then re-enter, pick up his weapon and enter the bank. Finally, a common access control chamber system could be evaded if while a customer was exiting from a chamber, an armed robber entered the bank through the exit outer door chamber and leaves a weapon for a second robber who is unarmed standing by the inner exit door. The second robber would then open the inner exit door and pick up the weapon. These and other methods of evading common access control chamber security systems render common access control chamber systems partially effective.

Protective door systems of the type which provides some degree of protection and security for banks and similar office environments are well known in the art. One well known device of this type (U.S. Pat. No. 4,060,039 to Lagarrigue) shows a security system having embodiments with a circular or a rectangular shape, the rectangular shaped embodiment having a side-by-side entrance and exit chamber, each with an entrance door into the chamber and an exit door out of the chamber. A control system causes the second door to lock when a weapon carried by a person is detected inside the entrance chamber, preventing the person carrying the weapon from entering the bank. If a weapon is not detected, the second door is unlocked only when the first door of the entrance chamber has been closed and locked. This prevents a person inside the entrance chamber from holding the second door open while another person who may have a weapon enters the entrance chamber. The first door cannot be opened when the second door is open or a person is on a contact pad on the floor of the entrance chamber.

The walls of the Lagarrigue access system are made of concrete and thus a person cannot be observed passing through the vestibule.

The metal detector in the Lagarrigue patent is only for detecting Ferro-magnetic metals such as steel, and operates on measuring changes in a static magnetic field (also called Continuous wave technology), not changes in high frequency electromagnetic fields. The metal detector in Lagarrigue also includes several magnetic field sources (such as ferrite magnets) arranged on each of the two side walls of the chamber and fills the area to be crossed by a person with magnetic fields. A series of large induction loops are adjoined to the magnetic field sources. An electronic device averages or adds the induction voltages being generated in the induction loops of the area crossed by the person. As a result, the reading obtained is practically independent of the location where the weapon is taken through the area.

One disadvantage of the Lagarrigue system is that the concrete walls must be poured at the assembly site, and must make use of molds to form the walls. Concrete construction is a very timely and costly construction method, and banks do not want to create a construction site at their front door.

Another disadvantage of the Lagarrigue system is the use of double doors. Banks want a system with a single door as opposed to double doors used in the Lagarrigue patent. Double doors require twice the number of locks, making the system more expensive, and the double doors provide a space or gap between them in which an intruder can insert a tool to pry open the doors, making the system less secure.

Another disadvantage of the Lagarrigue system is that the metal is—from a security standpoint—designed to detect "Ferro-magnetic metals" only, which in today's world is impractical, considering the wide array of weapons made from exotic, non-Ferro-magnetic materials such as stainless steel, zinc or aluminum and even plastics or ceramics.

Another disadvantage with the continuous wave based metal detectors of the Lagarrigue patent is that the detectors have high false alarm rates caused by poor electrical interference. The amount of electrical instrumentation used in today's environment is much more than at the time of the Lagarrigue invention. If the unit false alarms often, it will eventually be turned off or ignored by the security personnel, thus defeating its purpose.

Another disadvantage with the metal detector of the Lagarrigue invention is that, because the electronic device uses one series of loops to pick up the magnetic field generated by metals, the system cannot distinguish between a weapon and several pieces of metals carried by a person on several parts of the body, such as the keys, coins, metal watches, jewelry and other small items of metal carried by the person. Thus, the metal detector would indicate the presence of a weapon when no such weapon is present.

Another well known device of this type (U.S. Pat. No. 4,481,887 to Urbano) shows a security door and system of installation having bullet-proof walls and doors, the system being constructed in modular form for on-site assembly, the framework is made of steel or heavy aluminum, the vestibule (chamber) is rectangular or box shaped, the doors open automatically by photo cells, green and red lights indicating whether to wait or pass through the system, an automatic timing device is provided and operates after a person has entered the vestibule through the first door a predetermined time period to open the second door and allow the person to leave the vestibule and enter the building, overhead ventilators, the side walls and doors are made of transparent bullet-proof glass or plastic so that a person entering and leaving may be observed by bank personnel, and an overriding door lock system with a manually operated switch can be used whereby when a bank robber is within the exit chamber all the doors are locked to trap the robber therein. The Urbano system also discloses that the over-riding door lock switch can be operated remotely by a hand-held remote control unit, and briefly suggests that a weapon detector may be integrated into the operating circuit to lock the doors. The Urbano patent does not provide any teaching as to how the weapon detector can be integrated with the system, such as where the detector can be placed.

One disadvantage of the Urbano system is that the metal frame of the doors which open into the access chamber will interfere with a metal detector and produce false alarms if the metal detector is located inside the chamber. The metal detector must be located inside the access chamber in order that only one person can enter through at a time.

Another disadvantage of the Urbano system is the use of automatically opening doors. Banks want a system with manually operated doors as opposed to automatically operated doors. Automatic doors are more costly to maintain and operate by the bank, since repairs would require an electrician, and an electric motor needed to power the automatic doors would produce undesired magnetic fields that would reduce the sensitivity or accuracy of the metal detector.

Another disadvantage with the Urbano system is the use of double doors as discussed above with respect to the Lagarrigue system, whereby a space or gap is left between the doors that can be used to pry open the doors, and the doors require twice the number of locks.

Another disadvantage with the Urbano system is that the sides of the security chamber are formed of a single piece of bullet proof glass extending from the entrance end to the exit end of the chamber. This results in the requirement to use an extremely large piece of the bullet proof glass, which is extremely heavy and costly. When shipping and assembling the modular sections, the heavy piece of glass is harder to install than would two or more pieces. Also, if the glass was to break due to a fired bullet, the whole side section would require replacing instead of a smaller section.

Another well known device of this type (European Patent application 268,924-A to Maillot) shows an automatic access control airlock with a weapon detector having an eddy current movement detector, contact carpet presence detectors in the front and back of the passageway, locking and unlocking of the doors are controlled automatically by the presence detectors, the doors frames are made of a non-metallic material (fiberglass reinforced plastic), the first door opens toward the inside of the access chamber, the first and second door hinges are on the outside and are recessed, and the closing locking of both doors are set into the box frame. The non-metallic door frames is used for the purpose of reducing interference of the metal detector when the door opens toward the detector. The metal detector is located toward the first or entrance door.

One disadvantage of the European system is that the door frames are made of plastic. If the main frame is to be made of a metal such as aluminum, the cost and complexity of making the repairs is greatly increased because of the need of different materials and processes of making them. Also, if a repair of the door frame is necessary—such as when a bullet hole in the door must be repaired—the entire door would have to be replaced, resulting in the entire unit being shut down until a replacement door can be delivered from the manufacturer. Also, the plastic used in the door would tend to dry out over time and crack. Further, screws are used to secure parts to the plastic door frame. The plastic around the screws tend to fracture over time, and thus, the screws tend to come lose.

Another well known device of this type (U.S. Pat. No. 4,741,275 to Lewinder et al.) shows a device for controlling access of the security chamber which can unlock all doors in case of a fire so as to free the passage to the exit from the bank. Also shown is a wireless remote control unit which is used to change the operating mode of the security chamber.

A device for manually controlling access to a security chamber such as that described in U.S. Pat. No. 4,741,275 to Lewinder et al. might prevent robbers from evading or "tricking" a completely electronically controlled system. However, the Lewinder device would be completely ineffective if the human operator was removed by force or did not detect the "trick."

Another well known device of this type (U.S. Pat. No. 5,311,166 to Frye) shows a security vestibule having a security access system which preferably operates on a low voltage independent power source, and a high voltage DC power source is used to power a switch. This patent is silent as to what parts of the system use the low voltage power source and the high voltage power source.

One disadvantage of the systems in the prior art devices is that the doors are made from a metal, and can cause the metal detector to give false readings. A door that opens toward the metal detector provides a metallic material within the range of the metal detector's magnetic fields.

Accordingly, it is desirable to have an access control system that is more effective. The more effective method would be able to prevent the techniques described above for evading common access control chamber systems, and would meet with Access Control Unit Requirements for Financial Institutions in the United States. These requirements include:

1. Must have the ability to identify an armed person and prevent entry;
2. Low cost;
3. User friendly;
4. Low maintenance;
5. Made in the USA;
6. Fail Safe System;
7. Must meet ADA (Americans with Disabilities Act) and NFPA (Fire) Federal requirements;
8. Fully automatic control system normally requiring little operator intervention;

9. Bullet resistance glass and metal framing;
10. Ability to "lock" or to "unlock" all doors simultaneously;
11. Modular construction which would permit future relocation;
12. Low cost facility renovation to accommodate unit in existing doorways;
13. High flow (4–5 seconds process time per person);
14. Manually operated doors;
15. Must permit access by only one person at a time;
16. Ability to interface with building fire alarm system;
17. Ability to interface with local existing security alarm system;
18. Ability to discriminate between a weapon and other metals;
19. Ability to detect static metal inside the chambers (Weapons left on floor);
20. Ability to prevent straddling;
21. User may be allowed to exit the entrance booth if he so desires even thought he may be armed;
22. Integrated Close Circuit TV System interfaced with the system;
23. Ability to allow a second person to release the entrance door via a wireless button if the metal detector is activated;
24. Ability to detect a weapon if the person throws the weapon between the metal detector's panels, closer to the entrance door; and
25. Ability to allow an adult with a child to enter and exit.

Accordingly, a principal object of the present invention is to provide a security access system for banks or the like which satisfies fire department regulations, handicapped regulations, and which also meets the needs of the bank for reasonably rapid access and the prevention of robberies.

BRIEF SUMMARY OF THE INVENTION

In accordance with the present invention, one specific illustrative embodiment of the fail-safe access control chamber security system vestibule preferably includes the following features:

1. An entryway or entrance chamber at least seven feet long with an outer and an inner door to satisfy ADA requirements;
2. An exit passageway or exit chamber at least seven feet long with an inner and an outer door;
3. A metal detector located in the entrance chamber intermediate between the two doors;
4. Arrangements such as floor contact pads and other sensors in the entrance chamber to determine if a person has passed through the metal detector;
5. Control arrangements for preventing opening of both the inner and outer doors of the entrance chamber or the exit chamber;
6. Additional controls for preventing opening of the inner door of the entrance chamber unless the incoming person has successfully passed through the metal detector;
7. The width of the entrance and exit chambers should be at least 36 inches to accommodate wheelchairs;
8. The outer door and the inner door exit chamber should both open outwardly for fire escape and other emergencies;
9. A control circuit operable from the normal location of several employees such as bank tellers may be provided for locking the outer exit door of the exit chamber for holding a burglar seeking to leave the facility following a burglary
10. Transparent, bullet resistant walls may be provided for the entrance and exit chambers
11. An intercom may be provided to permit conversation with persons within the entrance or exit chambers;
12. A master control panel is preferably provided which may include controls which, for example, unlock selected doors to admit armed policemen or known wheelchair customers, unlock all doors in the event of a fire emergency, set off a panic alarm, or lock all doors in an attempt of a take over;
13. A video camera may be provided to transmit video images of all visitors to a remote secure location;
14. Floor scanning arrangements may be provided to preclude the possibility that would-be robbers would avoid the security measures by setting a weapon or package containing a weapon on the floor;
15. Preferably, during business hours, the outer door of the entrance chamber is unlocked when the inner door is closed to permit a would be burglar to leave; and
16. Presence detectors including photocells, radar, infrared signals, or other presence detectors, may be employed to insure that the incoming person does not straddle the entryway to subvert the security system by avoiding actuation of the foot pad switches, or leave a weapon inside the entrance or exit chamber.

Broader aspects of the invention involve the use of less than all of the above-enumerated security features.

For example, a fail-safe access control chamber security system vestibule may include a first interlocking door for providing passage from a non-secure area into the entrance chamber and a secure area. The entrance chamber may also include a first floor mat and a second floor mat located between the first and second interlocking doors to determine the location of a person within the entrance chamber. The entrance chamber would also have a means for preventing the simultaneous opening of the first and second interlocking doors.

The exit chamber would include a third interlocking door for providing passage from the secure area into the exit chamber to the non-secure area. A third floor mat located between the third and fourth interlocking doors would be used to determine the location of a person within the exit chamber. The exit chamber would also have means for preventing the simultaneous opening of the third and fourth interlocking doors. A control panel would preferably be provided to externally control and dual chamber ACU. Finally, a power supply would be connected to and supply power to the ACU.

The instant invention overcomes the above disadvantages and shortages of the prior art by providing an access control chamber security system with substantial improvements, such as;

providing for the chamber to be formed entirely of aluminum framing and bullet-resistant glass panels in the walls and doors, the chamber using a single metal detector in the center of the door system and spaced from the doors such that interference from the doors can be reduced or eliminated;

providing for the two side-by-side units to be capable of being split apart due to requirements of the building structure;

providing for the sides of the access control chamber to be formed of two sections with an aluminum framing member separating the two sections;

using metal door frames such that the interference therefrom does not interfere with the sensitivity of the metal detector, yet provide that the doors are made from the same material as the rest of the frame for the purpose of reducing the manufacturing costs and simplifying repair of damaged door frames;

providing a wireless remote control unit so that a second person can control the opening of the second door in the vent that the main operator must leave the area in which the main control panel is located;

providing a 24 volt dc power source for the metal detector and the magnetic locks for the purpose of preventing electrical shock to a person within the chambers who may be installing or working on the system or from a fired bullet that may short out the electrical system;

providing a battery backup at the control panel;

providing for the metal detector to operate at 24 volts dc in order to prevent noise, surges and peaks in the metal detector circuitry;

providing for the metal detector to remain on after the assembly has been shut down in order that humidity in the air will not accumulate on the electronics and cause the metal detector to short out and produce false alarms;

providing photocells for detecting if a person is standing on the frame and off of the detection pads such that the system would not detect the presence of a second person in the chamber; and providing a laser or infrared sensor to detect if a weapon has been left on the floor pads;

The preferred embodiment of the invention may also include the following additional features:

1. Preferably the metal detector used is able to distinguish between weapons and most other metal objects;
2. Wireless means for unlocking the inner entrance door No. 2 (such as a secondary remote control panel) may be provided to allow an operator to approach and visually examine the entrance chamber before unlocking door No. 2;
3. Preferably each door is equipped with high security closers with reliable magnetic locks;
4. The system may have an uninterrupted power supply which may keep the system operational during a natural or inflicted power outage;
5. The system is preferably provided with emergency override control;
6. As an option, the system may incorporate card readers which only allow entry to or exit from a chamber upon the insertion of a security card; and
7. As an option, closed circuit television or other electronic monitoring devices may be incorporated into the system.

One advantage of the present invention include maximum customer flow into the secure area with a new customer being admitted in approximately 3 to 5 seconds following entry of the prior customer. Another advantage of the present invention is that it provides a user friendly and safe environment. Yet another advantage of the present invention is its incorporation of sophisticated security technology such as metal detectors and other sensors.

The objects of the invention are realized in that the access control system utilizes a skeleton frame made of aluminum, door frames made of the same aluminum material to reduce the material list, the doors in the chamber of the metal detector swing outward to reduce interference therefrom, a metal detector located in the middle of the access control chamber, a 24 volt DC uninterrupted power supply (UPS) which can be plugged into a typical AC outlet and which uses common 24 volt DC batteries for the UPS source, the system and the metal detector operating under 24 volt DC so that the system can be installed in any part of the world with minimal modification and so that the possibility of electrocution during installation or if a fired bullet was to short out the system, using a wireless remote control box so that a second operator can control the opening of the exit door, keeping power supplied to the metal detector on at all times even after the rest of the system has been shut off after closing of the doors so that water vapor does not condense on the electrical circuits and produce shorts and false alarms, using photocells to project a beam of light along lower frame members to detect if a person is attempting to fool the system by straddling the floor pads, and using a laser or infrared sensor to project a beam along the floor to detect if a weapon or other object was left on the floor.

Other objects, features and advantages of the present invention will become apparent from a consideration of the following detailed description, and from the accompanying drawings.

BRIEF DESCRIPTION OF THE DRAWINGS

FIG. 6A is a schematic top view of the ACU of FIG. 2

FIG. 6B is a schematic diagram of the ACU taken along line *6b—6b* of FIG. 6-A.

FIG. 6C is a schematic exterior view of the ACU

FIG. 6D is a schematic interior view of the ACU

DETAILED DESCRIPTION OF THE PREFERRED EMBODIMENTS

Figure 1:
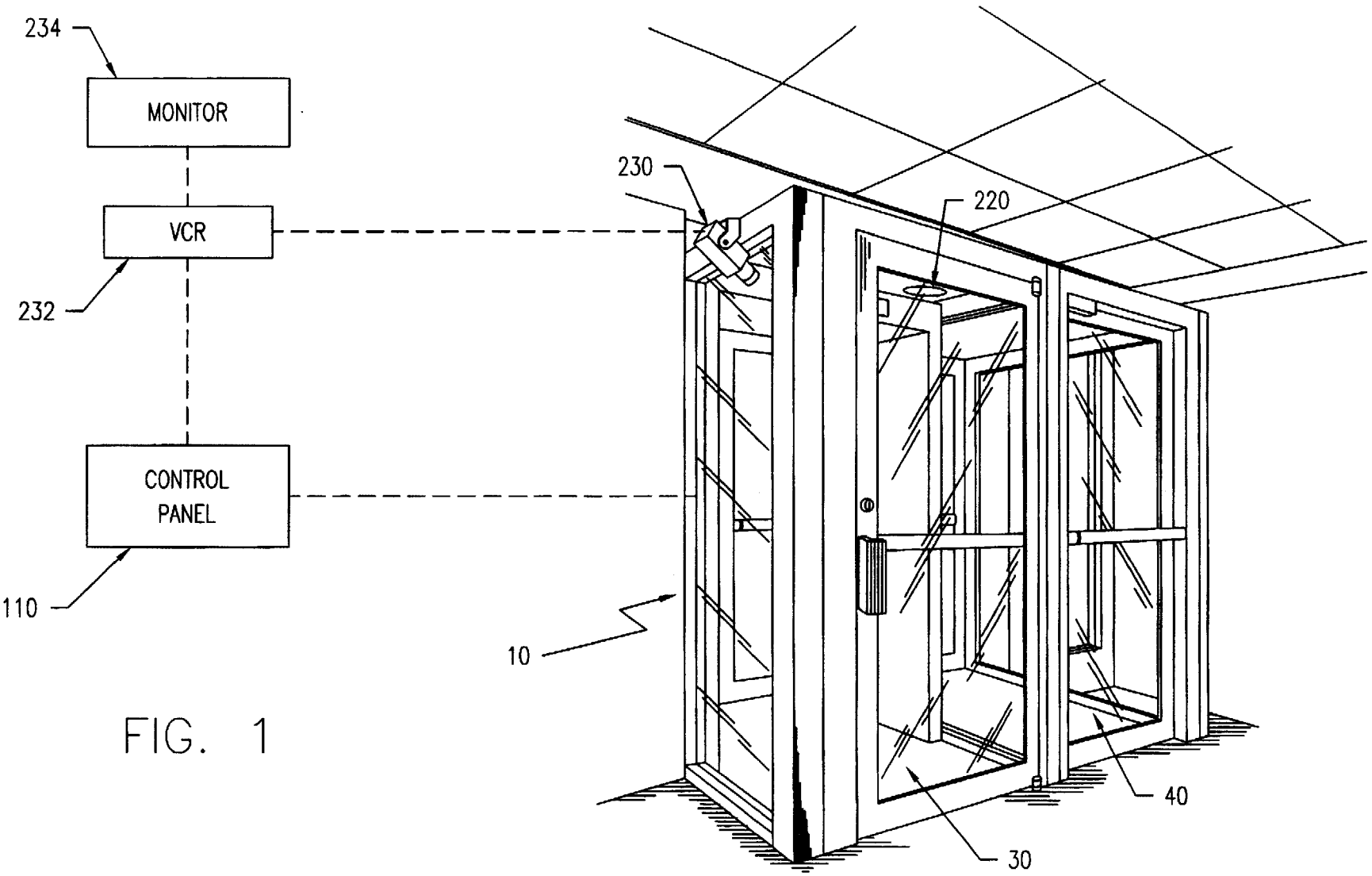
FIG. 1 is a perspective view of an illustrative preferred embodiment of the invention from an interior angle.

The preferred embodiment of the present invention, an access control vestibule, preferably includes an access control unit (ACU) 10 having an entrance chamber 12 which includes a metal detector 60 and an exit chamber 14, a control panel 110, and a power supply 160. The vestibule also preferably includes switching arrangements 180 for remote personnel, such as bank tellers, to provide a control signal to prevent exit from the exit chamber 14.

Figure 2:
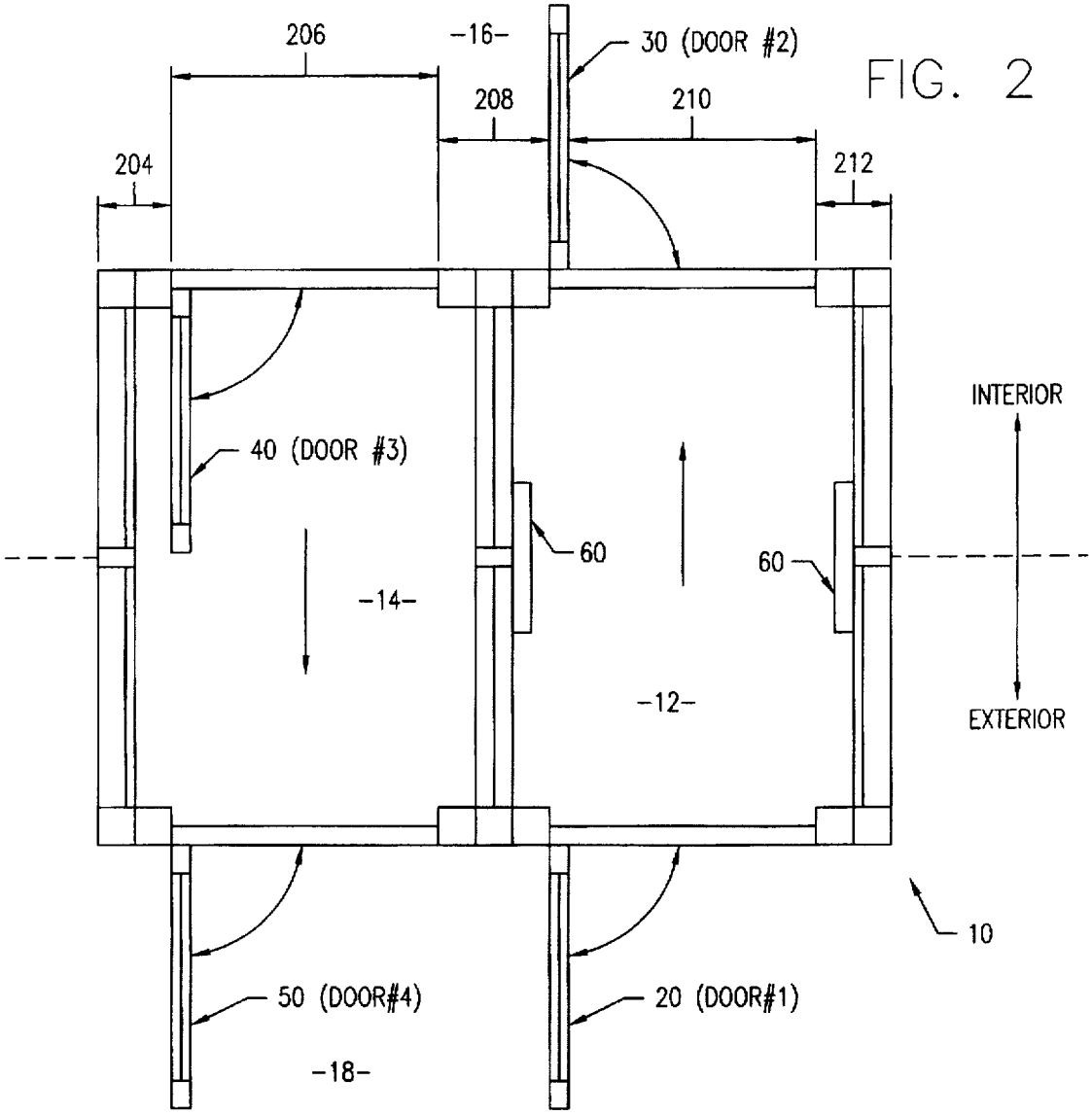
FIG. 2 is an overhead schematic diagram of the preferred embodiment of the access control unit (ACU) including an entrance chamber and an exit chamber

Referring more particularly to the drawings, FIG. 1 is a depiction of a perspective view of a preferred embodiment of the ACU 10 as viewed from the interior 16 of the protected area. FIG. 2 shows an overhead schematic diagram of the ACU 10. The ACU 10 includes an entrance passage or chamber 12 which allows controlled departure from the exterior 18 of a structure such as a bank to the interior 16 of the structure. The entrance chamber 12 preferably includes double interlocking doors 20 and 30 and a metal detector 60. The ACU 10 also includes an exit passage or chamber 14 which allows controlled access from the interior 16 to the exterior 18 of a structure. The exit chamber 14 preferably includes double interlocking doors 40 and 50.

Incidentally, in the following specification the outer entry door is referred to both as the No. 1 door, and by reference numeral 20, the inner door is referred to both as to the No. 2 door and as door 30, and the two exit doors are referenced both as the No. 3 and No. 4 doors and by reference numerals 40 and 50 respectively.

Figure 3:
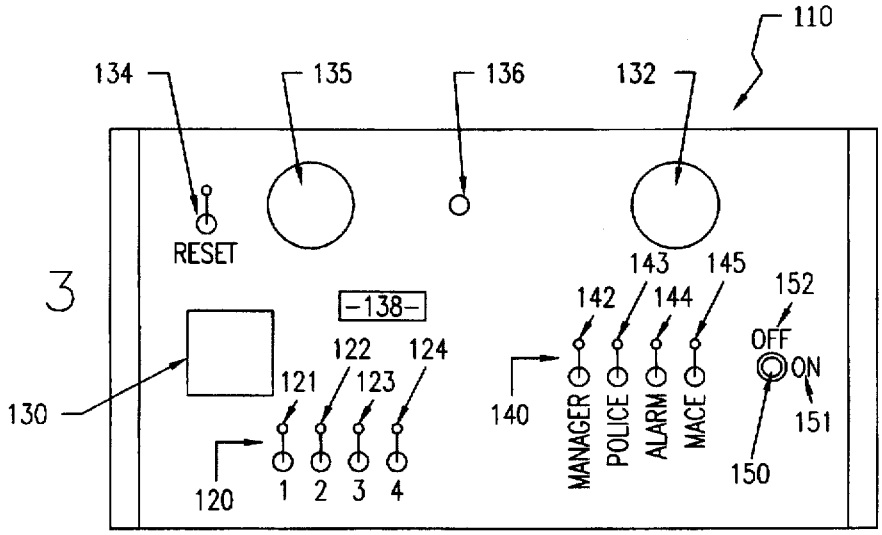
FIG. 3 is a front view of a control panel which may be employed in the access control system.

The vestibule would preferably include a control panel 110 which would provide multiple alarm features from a location remote from, but preferably in view of, the ACU 10. FIG. 3 shows a preferred embodiment of a control panel. The control panel 110 preferably has four door toggle switches 120 which may be marked "1," "2," "3," and "4" to control the doors of the chambers 20, 30, 40, and 50 respectively.

The normal operational position of the door toggle switches 120 is preferably "down," indicating automatic actuation. One or more of the doors may be locked by toggling the desired door switch "up." Please note that these positions could be reverse without changing the intent of the invention. The control panel 110 may also include a door No. 2 release button 130 to release door No. 2 if the metal detector 60 is activated. The door No. 2 release button 130 would allow an operator to enter the entrance chamber 12 to inspect and/or remove the object which triggered the metal detector 60, or to permit the entry of a known wheel chair customer or a known armed policeman. Alternately or in addition to the door No. 2 release button 130, a wireless transmitter and receiver door No. 2 release button (not shown) may be included in the vestibule to allow a second operator to release door No. 2 from any position in the secured facilities. In the event that the main operator needs to leave his position near the main control box, such as for going to the bathroom or into the vault, the main operator can leave the wireless remote control box with a second person or operator. The second operator can then control the opening of the door from their own desk without having to travel to the main control panel.

The control panel 110 may also include an emergency button 132 that will release all doors (20,30,40 and 50) in the event of fire or any other emergency. The emergency button 132 may also be used to de-activate the vestibule at the end of the day when everybody is leaving the building and the doors are going to be locked with a key. In the preferred embodiment, the metal detector 60 remains on at all times after the system has been shut down for the night or after closing of the bank. Since the air in the bank or building contains water vapor, water can form on the electronics of the metal detector when the air conditioning in the building has been shut off or lowered due to closing. The water can short out the metal detector. I have found that leaving the metal detector on after the rest of the system has been shut off prevents the water from forming on the electronic circuit of the metal detector and eliminates the false alarms resulting from the electrical shorts.

The control panel 110 may also include means 140 for controlling specific alarm features. The alarm features may be controlled by an alternate action key switch 150 and toggle switches (142, 143, 144, and 145) may be set to operate only when the key switch 150 is in the "on" position 151 and not when it is in the "off" position 152. Preferably the toggle switches (142, 143, 144 and 145) will only operate in a predetermined sequence (i.e., manager switch 142 enables police switch 144, etc.). These switches, however, could operate separately without changing the scope of the invention.

A switch 142 may be provided to activate an alarm to advise the manager of the institution if there is any problem. Another switch 143 may be provided to activate the panic alarm system of the institution that alerts the police department. Another switch 144 may be provided to activate an alarm inside the entrance chamber in case of someone brandishing a weapon. One or more additional features such as a switch for activating a camera or for providing means of subduing the person in the chamber such as by spraying the person with MACE, by the activation of a high pitched, high intensity siren, or by other known means.

It should be noted that the features described on the control panel 110 are meant to be exemplary and are not meant to limit the scope of the invention. For example, a reset button 134 may be provided to reset the vestibule. A metal detector alert means 135 such as speaker for a pulsating audible is sound or flashing LED may also be included. Another optional feature might be an ADA alert LED 136 may be provided to alert the operator that a disabled person needs assistance. There may also be intercom 138 with a microphone, speaker, and controls which allows the operator to communicate with persons in the chambers 12 and 14. Further, the control panel may be constructed so as to utilize technology such as digital control buttons, analog switches and dials, mechanical means or any know technology. For example, the toggle switches 140 may be replaced by capacitance actuated switches, by a key pad with numbered buttons, or a dial with specific positions.

Figure 4A:
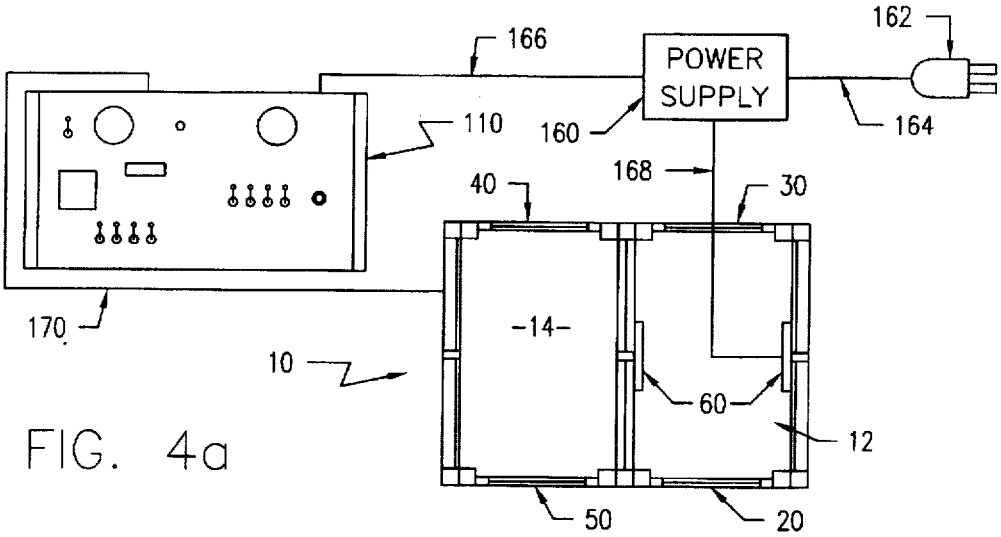
FIG. 4A is a schematic diagram of the connections between the teller's switches and the exit portal of the system.
Figure 4B:
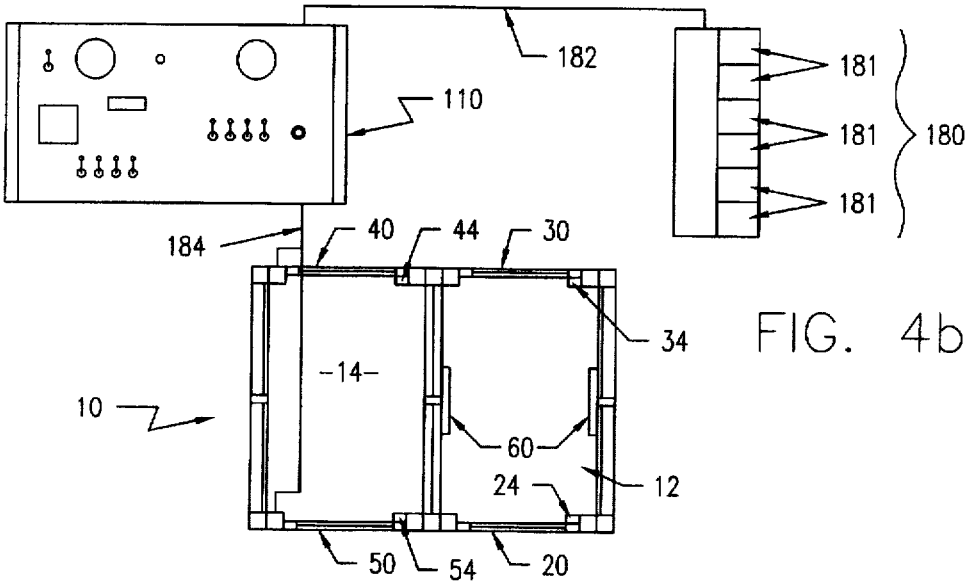
FIG. 4B is a schematic diagram of the connections between the teller's switches and the exit portal of the system.
Figure 4C:
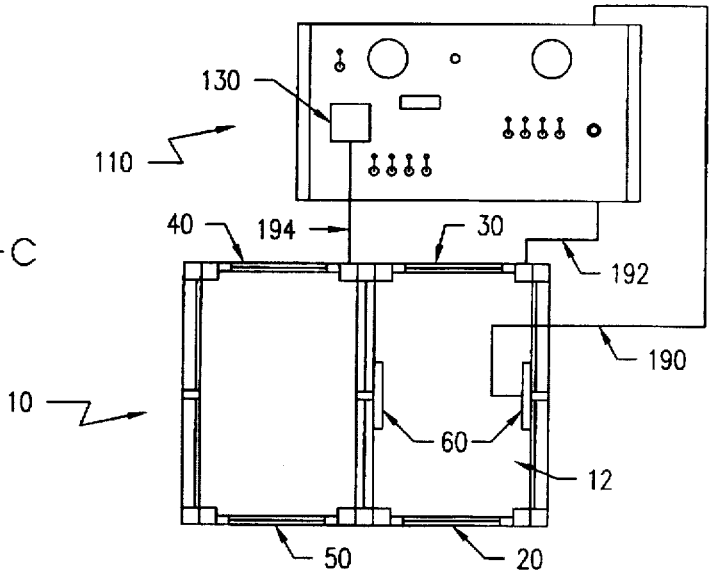
FIG. 4C is a schematic diagram of the connections involving the metal detector in the illustrated access control system.

The control panel may be connected to the vestibule as shown in FIG. 4A (power connections), FIG. 4B (connections between the teller's switches and the exit portal), and FIG. 4C (connections to the metal detector). The connection may be accomplished by means of "hard-wiring" or wireless means such as radio waves, infrared ray ultrasonic waves, or other means of wireless connection.

FIG. 4A shows a preferred power connection of the present invention. Power supply 160 is preferably a 24 VDC which may be connected by means 164 to a 110 VAC wall outlet power supply 162. The power supply may also be an independent power supply such as a battery or generator or may have similar means of back-up power supply in the event that power from the wall outlet 162 fails or is prevented. Using a 24 volt DC power source instead of high voltages like 110 AC or 220 AC (vac) would be safer, since a person is not likely to be electrocuted from 24 volts such as when installing the system or if a fired bullet was to electrically short the system out. Using 12 volts DC (vdc) would require more power and more current than would 24 vdc, and thus would also would require larger wires to carry the larger current. Installing a system with 110 vac would also require a licensed electrician, and that would increase the cost of installing the system. A licensed electrician would not be needed with the smaller voltages of the present invention. Also, a battery backup for 24 vdc power supply would need only to use low-priced 24 volt batteries. A high voltage source like 110 vac would require an expensive uninterrupted power supply (UPS). Using an alternating current like 110 vac would also cause false alarms in the metal detector because of the electrical noise, surges and peaks. The power supply 160 is connected to the control panel 110 by wiring 166 to supply 24 VDC to the control panel 110. The power supply 160 is also connected to the metal detector 60 by means 168 to supply 24 VDC to the metal detector 60. 24 VDC is preferably supplied from the control panel 110 by wiring 170 to the ACU 10 to control such features as the Magnetic Locks (24 and 34 in FIG. 5A and 44 and 54 in FIG. 5B), push bars 25 and 55 in FIG. 6C and 35 and 45 in FIG. 6D), and other devices needing power (such as buttons, sensors, and alarms). These power connections are meant to be exemplary and are not meant to limit the scope of the invention.

Another benefit to using the 24 volts DC power supply is that the system can readily be adapted for use in countries around the world that use a wide variety of voltages. Some countries, like England, use 220 volts to make the system usable with the 220 volt power supply in England, all that needs to be modified is the voltage regulator in the power supply box, which is an inexpensive modification of about $40.

Figure 8A:
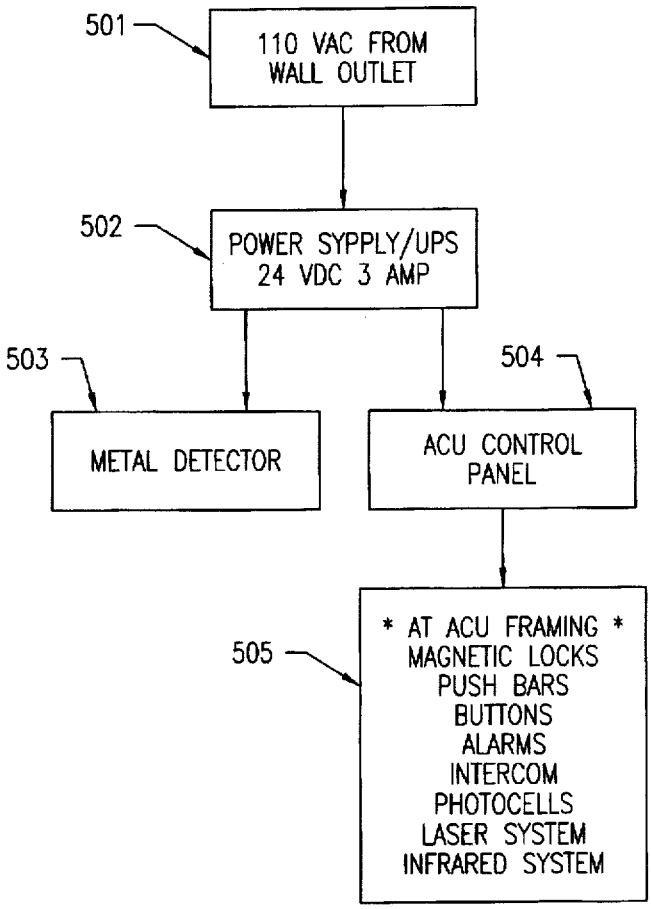
FIG. 8A is a block diagram of the power requirements of the present access control system

FIG. 8A is a block diagram of one embodiment of the power requirements and system shown in FIG. 4A. 110 VAC from a wall outlet as indicated by block 501 is input into a power supply 502. The power supply 502 supplies power to the metal detector 503 and the ACU control panel 504. The ACU control panel 504 in turn supplies power to the magnetic locks, push bars, buttons, alarms, intercom system (speakers 220 shown in FIG. 1), photocells, laser system, infrared system, and other elements of the ACU requiring power as indicated by block 505.

FIG. 4B indicates schematically the connections which allow employees, such as tellers, at fixed locations, such as the teller counter 180, to remotely prevent exit from the exit chamber 14. This feature would allow a teller to prevent the escape of a robber. The teller counter 180 would have multiple switches or buttons 181 which the teller could use in the event of a robbery. The switches 181 are preferably connected to the control panel 110 by wiring 182. The control panel 110 then sends a signal via circuit 184 to the ACU 10 prevent the No 4 door 50 from opening by maintaining energization of the magnetic lock 54, as well as the magnetic lock 44 on the No. 3 door 40. These connections are meant to be exemplary and are not meant to limit the scope of the invention. For example, the teller switches 181 could be connected directly to the No. 4 door 50.

Figure 8H:
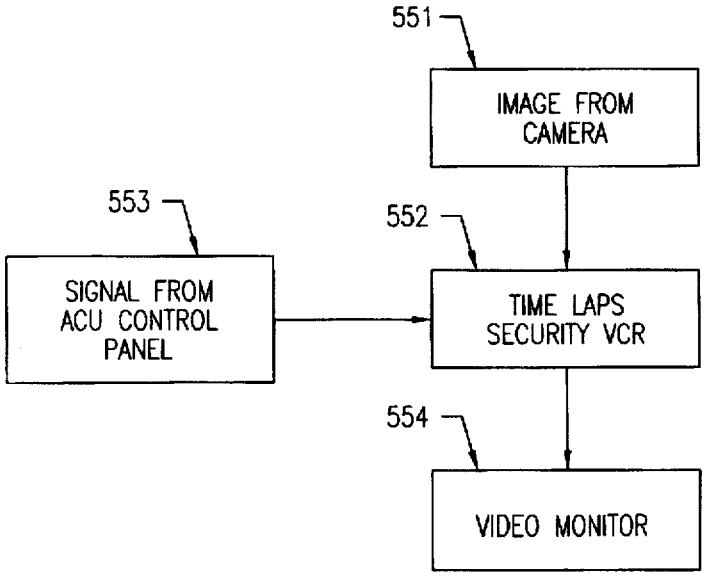
FIG. 8H is a block diagram of the entrance chamber camera system interface of the system.
Figure 8B:
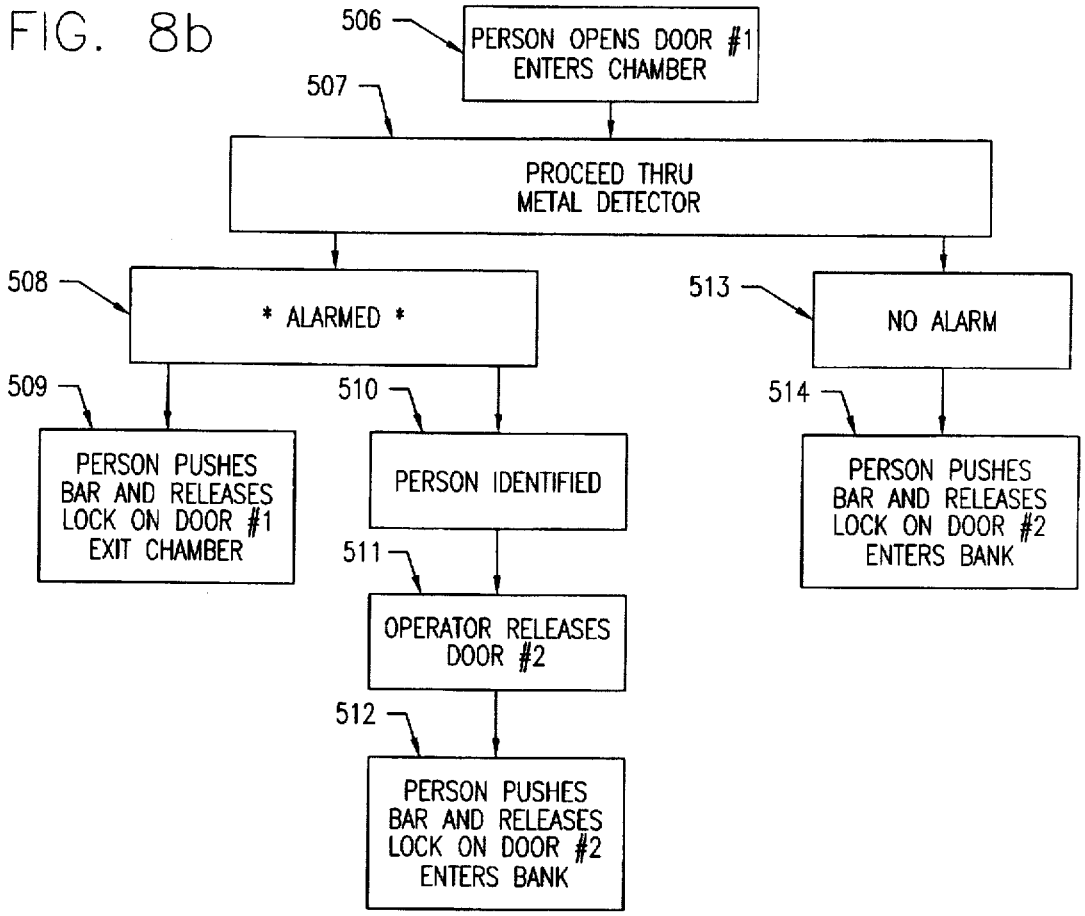
FIG. 8B is a block diagram of the entrance chamber metal detector interface of the present system.
Figure 8D:
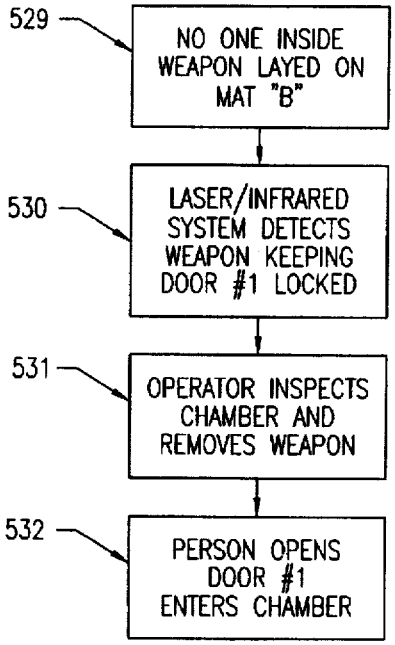
FIGS. 8C–8D are block diagrams of the entrance chamber interlocking doors system of the present ACU invention.
Figure 8C:
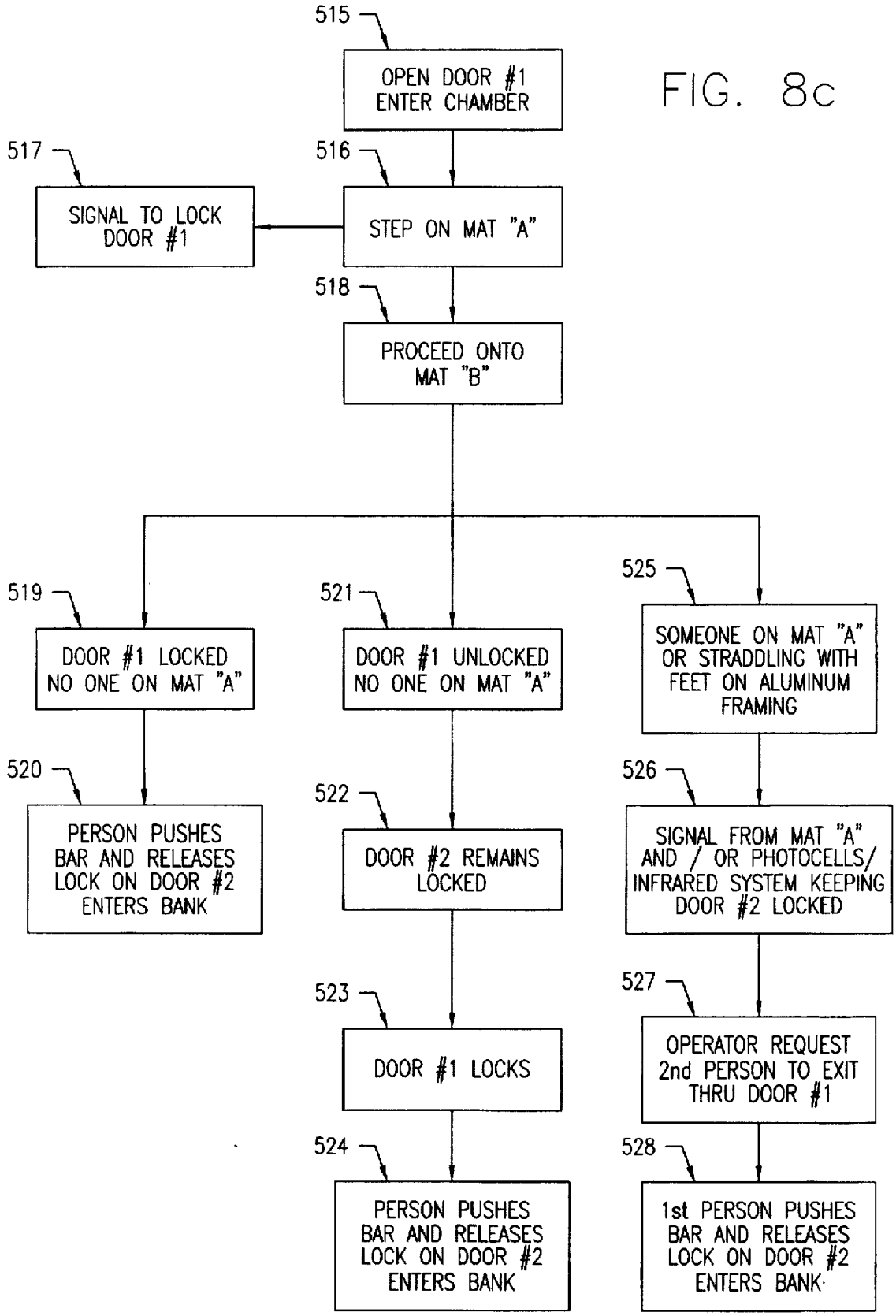
Figure 8E:
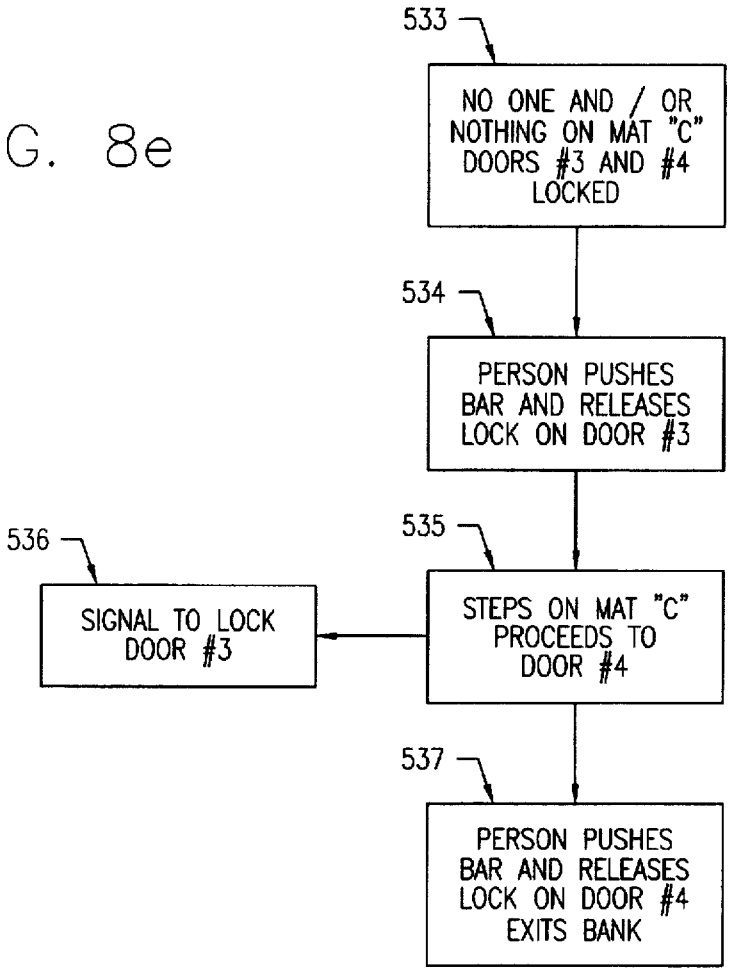
FIGS. 8E–8F are block diagrams of the exit chamber interlocking doors system of the ACU.
Figure 8J:
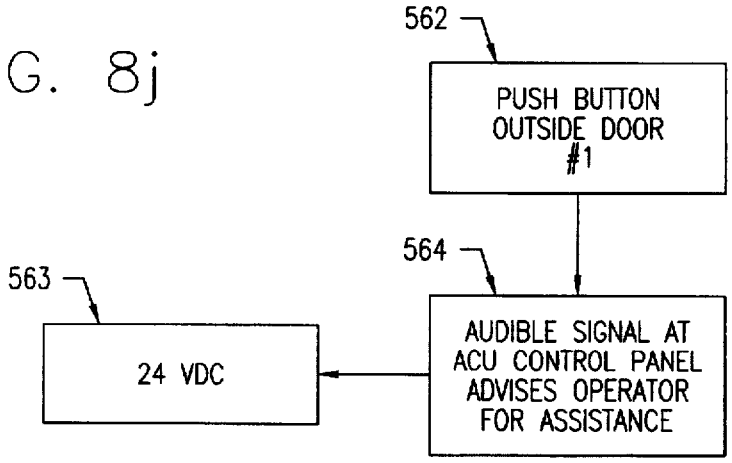
FIG. 8J is a block diagram of the operation of the ADA assistance push button arrangements of the access control system.
Figure 8F:
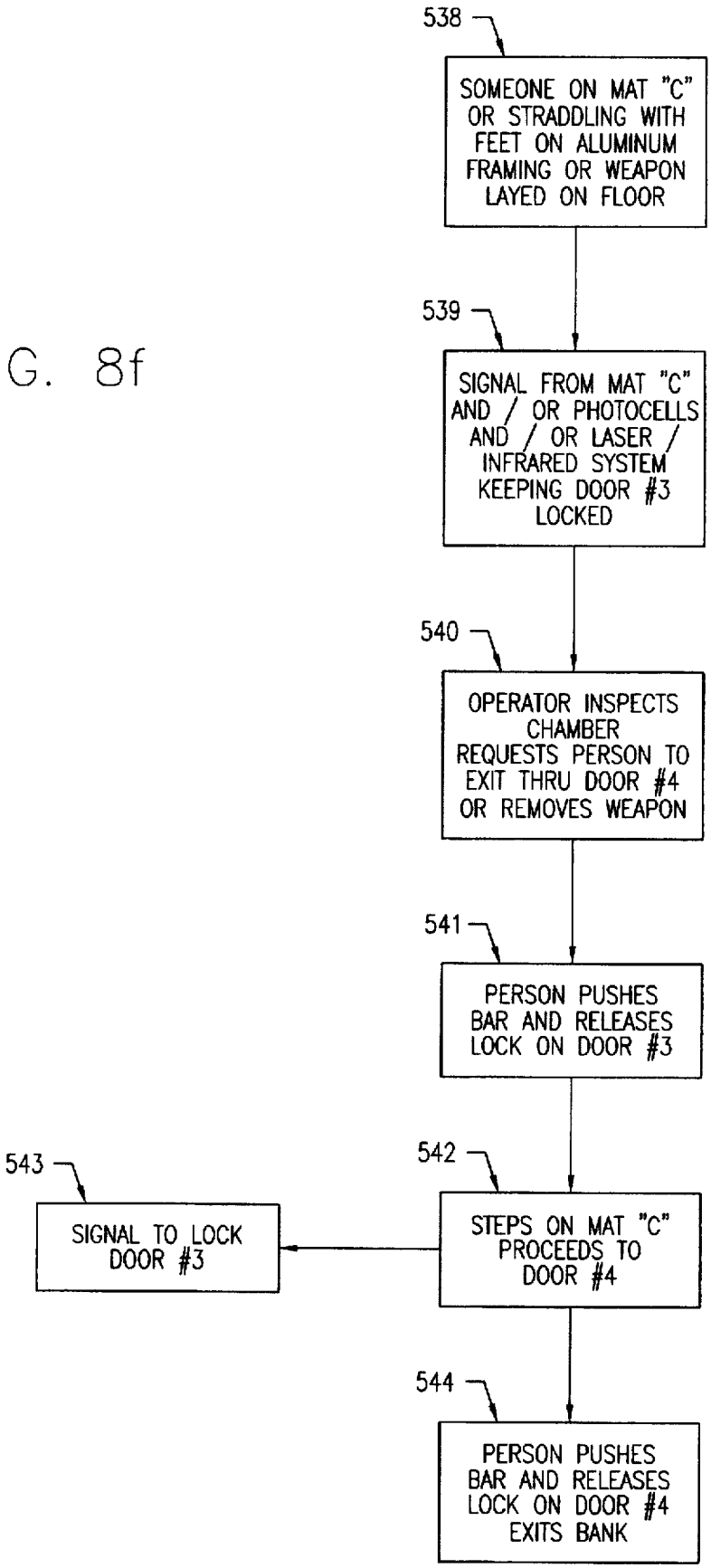
Figure 8G:
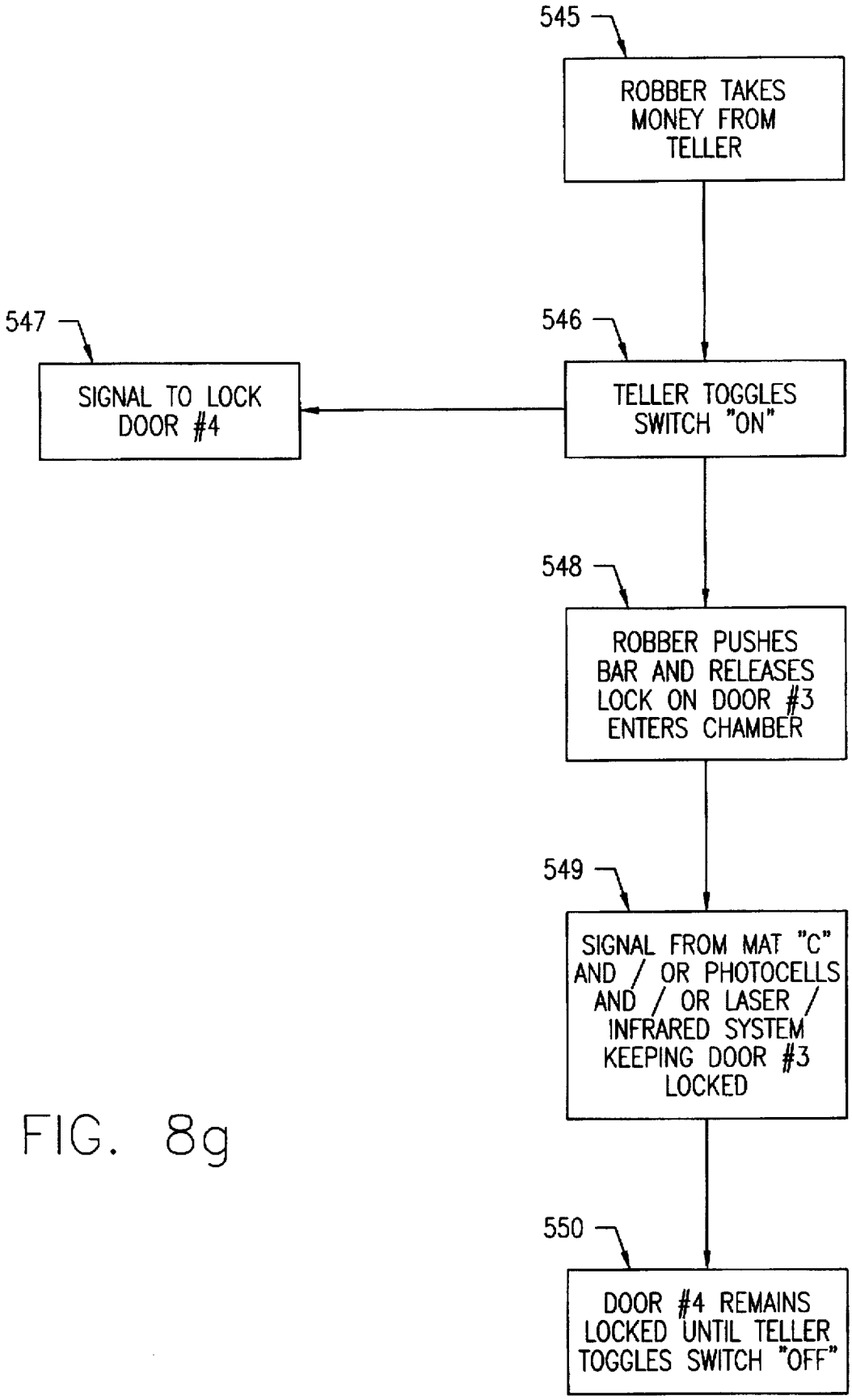
FIG. 8G is a block diagram of the operation of the tellers' toggle switches to close the exit chamber of the access control system.
Figure 8I:
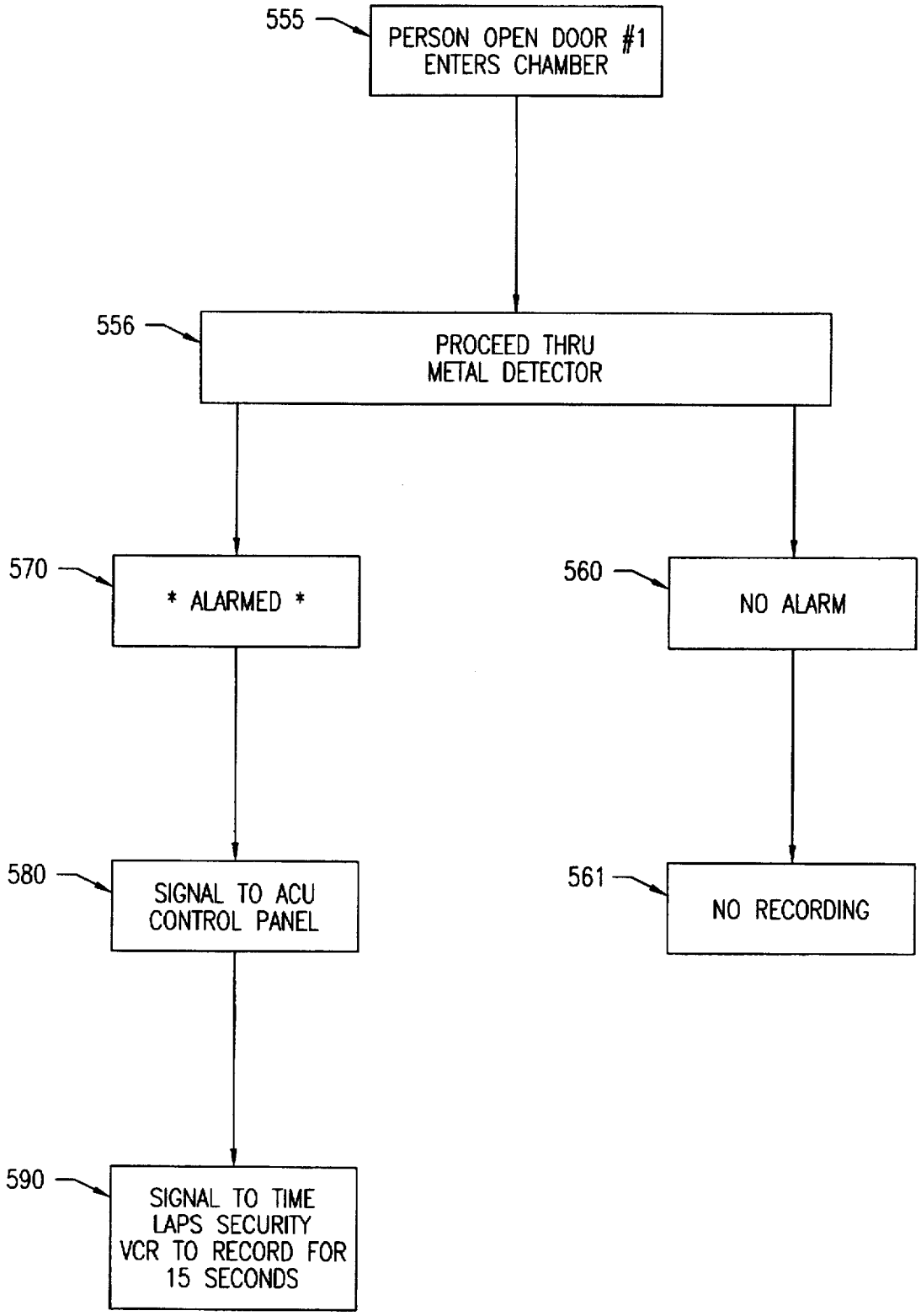
FIG. 8I is a block diagram of the entrance chamber metal detector system interface of the system.

FIG. 8G is a block diagram indicating the operation of the teller's toggle switches to lock the exit chamber. When a robber takes money from a teller as indicated by block 545, the teller toggles a switch "on" as indicated by block 546. A signal is then sent directly or indirectly to lock door No. 4 as indicated by block 547. The robber pushes the push bar on door No. 3 and releases the lock on door No. 3 and enters the exit chamber 14, as indicated by block 548. When the robber steps on mat C, activates the photocells, and/or triggers the laser or infrared system, a signal is sent from the triggering device which keeps door No. 3 locked as indicated at block 549. The robber is unable to leave the exit chamber 14 because door No. 4 remains locked until the teller toggles the activated switch "off" per block 550. The robber is thus held in exit chamber 14 until the police arrive.

FIG. 4C shows the vestibule contacts for the metal detector 60. More specifically, the metal detector 60 sends a signal (when activated) by the circuit 190 to the control panel 110. The control panel 110 circuitry then operates through circuit 192 to hold No. 2 door 30 locked. An operator may release No. 2 door 30 by pushing a release button 130 whereby the control panel 110 sends a signal through circuit 194 to release No. 2 door 30. These connections are meant to be exemplary and are not meant to limit the scope of the invention. For example, the metal detector 60 could be directly connected to No. 2 door 30. Also, as indicated above, there may be alternate methods of releasing No. 2 door 30. Normally, of course, when the entering person steps from the first mat onto the second mat 92, without activating the metal detector 60, the second inference door 30 is unlocked; but this action is blocked by a positive response from the metal detector 60.

As described above, the ACU 10 is designed to control or meter access into and egress out of a secure facility using an entrance chamber 12 having dual interlocking entrance doors (20 and 30) and an exit chamber 14 having dual interlocking exit doors (40 and 50).

Figure 5B:
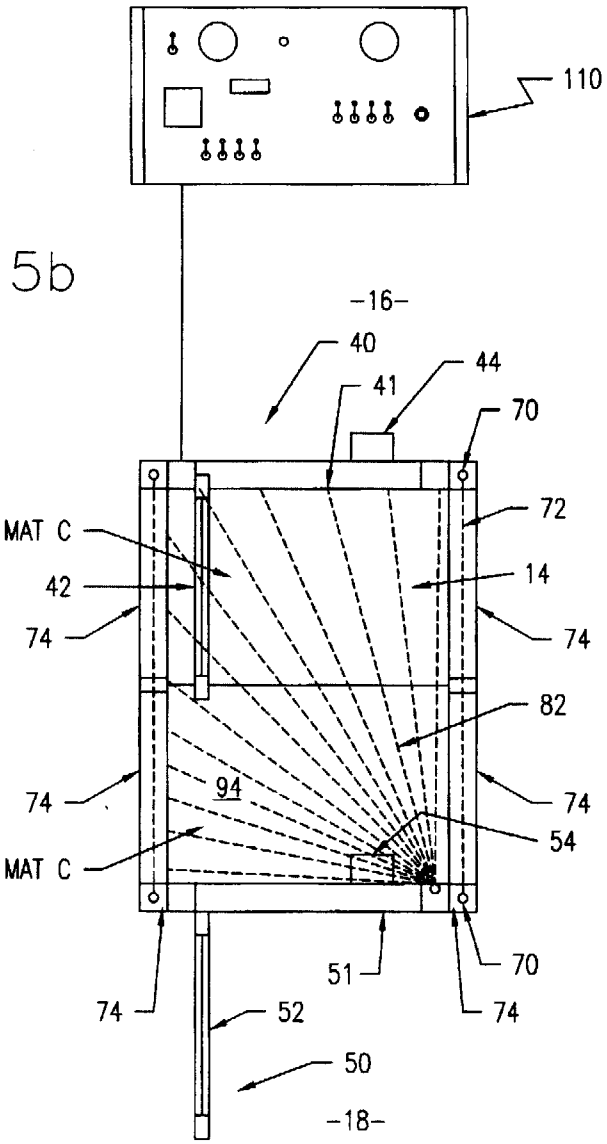
FIG. 5B is a schematic diagram of the exit chamber interlocking doors system.
Figure 5A:
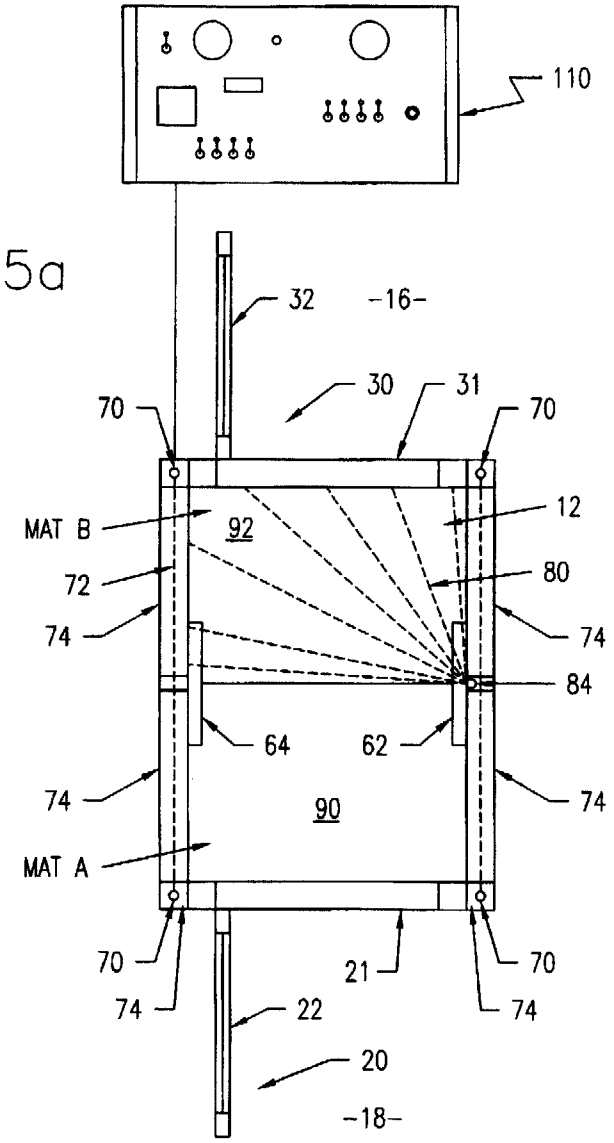
FIG. 5A is a schematic diagram of the entrance chamber interlocking doors system.

FIG. 5A shows the entrance chamber 12 which controls access using a dual interlocking entrance door system (20 and 30). The doors 20 and 30 are located on either end of the chamber 12 and preferably have electromagnetic locks (24 and 34) and touch sense bars (25 and 35, FIGS. 6C–6D). The exterior No. 1 door 20 is normally in the closed position 21, but may be brought to an opened position 22 by manually pulling exterior handle 26 (FIG. 6C) so that the door opens outward. No. 1 door 20 may also include a push bar 25 (FIG. 6C). The interior No. 2 door 30 is normally in the closed position 31, but may be brought to an opened position 32 by pushing push bar 35 (FIG. 6D) so that the door opens outward into the interior 16 of the secured facility. No. 2 door 30 may also include a handle 36 (FIG. 6D) on the "interior" side of the door which the operator may use to manually open No. 2 door 30 after it has been release by the control panel or other means. Within the entrance chamber 12 is a metal detector 60 located approximately halfway between the No. 1 door 20 and No. 2 door 30. The entrance chamber 12 may also include other sensors such as photocells 70 and a laser source 84.

Entrance access is controlled by the entrance chamber 12 so that only one person at a time may access the secured facilities or structure. Normally, the outer or exterior No. 1 access door 20 is unlocked until someone enters and stands on the first Mat 90 also designated Mat A, which triggers the system to lock and secure No. 1 door 20 in the closed position 21 and prevents No. 1 door 20 from being opened from the exterior 18 of the secured environment. The person then proceeds through the metal detector 60 and onto mat 92

(Mat B). If no metal is detected, the person simply opens No. 2 door 30 and enters the interior 16 of facility without any intervention from the operator.

If metal is detected, the inner No. 2 door 30 is locked and a metal detector alert 135 such as a pulsating audible is sounded or a flashing LED is triggered on the control panel 110 (also see FIG. 3). At this point, there are several options; the person can return to the outer entry door 20 and leave the chamber 12 freely or the operator may push a button 130 (FIG. 3) to release the No 2 door 30. The operator may also decide to toggle the No. 1 control panel door switch 121 "up" which will trap the person in the chamber 12, not allowing access or egress. This scenario may be used when someone is brandishing a weapon and the police are being called.

If two people enter chamber 12 through the No. 1 door 20 and one of them stands on the outer mat 90 and the other stands on the inner mat 92, the inner entry door 30 will not open. If one of the persons tries to stand off the mat by straddling and putting his feet on the aluminum or other suitable material framing 74 (see also FIG. 6B) a set of photo-cells 70 will detect the feet on the framing 74 and will not allow No. 2 door 30 to open. One of the persons must exit the chamber 12 and may return only when the first person exits the entrance chamber 12.

If a person enters through the No. 1 door 20 with a weapon, activates the metal detector 60, and leaves the weapon on inner entry mat 92 and walks back out a sensor device such as laser/infrared system (72 and 74) will detect the weapon on one of the floor mats (90 or 92) and prevent the No. 1 door 20 from opening until the chamber 12 is inspected and the weapon removed.

FIG. 8B shows the entrance chamber metal detector mode of operation in block diagram form. The interface is triggered when a person opens door No. 1 and enters the entrance chamber 12 as indicated by block 506. The person then proceeds through the metal detector 60, see block 507. If no metal is present, the alarm does not sound, see block 513 and the person pushes the bar to release the lock on the inner entry door 30 and enters the secured facility as indicated by block 514. If metal is present, the alarm is triggered, per block 508 by the metal detector. The system may be configured to allow him to leave the weapon on mat B, push the bar to release the lock No. 1 door 20 and exit the entrance chamber to the exterior of the secured facility, see block 509. If the person in the entrance chamber is an identified law enforcement officer, is a disabled person in a wheelchair, or is otherwise identifiable to the operator 510, the operator may release the No. 2 door 30, per block 511 and thus allow the person to push the bar to release the lock on inner entry door 30 and enter the secured facility as indicated by block 512.

FIG. 8C and 8D show the mode of operation on the entrance chamber interlocking door system in block diagram form. When nobody is using the doors or is inside the entry chamber 12, the No. 1 outer entry door 20 may be opened and a person may enter the entrance chamber as indicated 515. When the person steps on mat A per block 516, a signal is sent to lock No. 1 door 20, per block 517 so it is secure and cannot be opened from the outside. The person then passes through the metal detector and proceeds onto mat B, see block 519, the person may open the inner No. 2 entry door 30 and enter the secured facility, as indicated by block 520 if the metal detector is not activated. If outer No. 1 entry door is unlocked and no one is on mat A per block 521, and door No. 2 remains locked, then door No. 1 locks, per block 523 and the person may open inner No. 2 entry door 30, and enter the secured facility per block 524.

However, if two people enter through door No. 1 and one of them stands on mat A and the other stands on mat B, door No. 2 will not open. If one of the persons tries to stand off the mat by straddling and putting the feet on the aluminum framing, see block 525, a set of photocells or other sensors will detect the feet on the framing and will not allow door No. 2 to open, per block 526. In this case the operator may request the second person to exit through door No. 1 as indicated by block 527. The person remaining in the entry chamber 12 may then open door No. 2 and enter the secured facility, per block 528. Finally, as shown, in FIG. 8D, if no one is inside the chamber, but a weapon is on mat B, per block 529, the sensor system will detect the weapon and keep door locked in accordance with block 530 until operator inspects the chamber and removes the weapon, see block 531. A person may then push open outer entry 1 and enter the entrance chamber, per block 532.

FIG. 5B is a schematic diagram of the exit chamber 14 with its interlocking door system which controls egress from the secured facility. The exit chamber has two doors 40 and 50 on either end of the chamber which also preferably have electromagnetic locks (44 and 54) and touch bars (45 on FIG. 6D and 55 on FIG. 6C) mounted. The interior No. 3 exit door 40 is normally in its closed position 41, but may be brought to an opened position 42 by activating the touch bar 45 (FIG. 6D) so that the door opens inward into the exit chamber 14. The exterior No. 4 exit door 50 is normally in its closed position 51, but may be brought to an opened position 52 by pushing push bar 55 (FIG. 6C) so that the door opens outward towards the exterior 18 of the secured facility. The exit chamber 14 may include sensors such as photo-cells 70 and laser source 80.

Exiting the facility is accomplished by simply pushing the No. 3 door 40. If the chamber 14 is empty and No. 4 door 50 is closed, the person or persons are free to enter the chamber 14. Once in the chamber 14, mat C 94 will detect the person's presence, locking door No 3,40 once the door closes, thus preventing re-entry or additional people from entering the chamber 14. The person then must activate the push bar 55 (FIG. 6C) to unlock No. 4 door 50 and exit the chamber 14.

If robbery occurs, the tellers are provided with a switch 181 (FIG. 4B) that will lock outer No. 4 exit 50 and trap the person in the chamber 14, not allowing egress. Doors 3 and 4 may also be locked from the control panel using the switches marked "3" and "4" (123 and 124) on FIG. 3).

If the person tries to stand off mat C, reference numeral 94 by straddling and putting his feet on the aluminum framing 74( FIG. 6B), a set of photo cells 70 will detect the feet on the framing 74 and will prevent the No. 3 inner exit door 40 from opening.

If a person enters the chamber 14, leaves a weapon on mat C, reference numerals 94, and returns to the interior 16 of the secured facility, a laser/infrared system (80 and 82) will detect the weapon on the floor, not allowing No. 3 inner exit door 40 to open until the chamber 14 is inspected and the weapon removed.

FIG. 8E and 8F are block diagrams of the mode of operation of the exit chamber 14 interlocking door system of the present invention. As shown in FIG. 8E when there's nobody using the doors or inside the chamber, doors No. 3 and No. 4 are secured as shown by block 533. When somebody is leaving the secured facility and touches the electronic bar on door No. 3, the lock is release see block 534. As the person steps on mat C, per block 535, a signal is sent to lock door No. 3, per block 536 so that it cannot be opened from chamber 14. The person then can open door No. 4 by activating the push bar to release the lock, and exit the secured facility in accordance with step 537.

As shown in FIG. 8F, if the person tries to defeat security by standing off the mat by straddling and putting his feet on the aluminum framing, or by laying a weapon on the floor, per block 538, a set of photo cells or other sensors means will detect these circumstances, and a signal will be sent to prevent inner exit door No. 3 from being opened, per block 539. An operator may then inspect the chamber, request the person to exit through door No. 4, or remove the weapon, per block 540. A person may then push the bar on door No. 3 to release the lock 541. As the person steps on mat C, per step 542, a signal is sent to lock door No. 3,543 so that it cannot be opened from within chamber 14. The person then can open door No. 4 by activating the push bar to release the lock and exit the secured facility, in accordance with step 544.

In the preferred embodiment, electromagnetic locks (24, 34, 44, and 54) would be positioned on the top frame of the ACU as shown in FIGS. 5A and 5B. The locks would come into contact with a magnetic strike plate (not shown) on the corresponding top frame of the door. When activated, the electromagnetic locks would secure the doors. When released, the electromagnetic locks would allow the doors to open. An electromagnet access control circuit such as that described in U.S. Pat. No. 4,682,801 to Cook et al. and assigned to Securitron-Magnalock Corporation would be appropriate to use with the present invention. A magnetic locking status detection system such as the one described in U.S. Pat. No. 4,516,114 to Cook and assigned to Securitron-Magnalock Corporation could be used to connect the electromagnets to the microprocessor 400 (FIG. 7) and provide status information.

The touch bars (25, 35, 45, and 55) as shown in FIGS. 6C and 6D may be part of a touch bar release locking system of the type described in U.S. Pat. No. 4,871,205 to Cook et al. and assigned to Securitron-Magnalock Corporation.

FIG. 6A is a schematic diagram of the preferred embodiment taken from the top view. The top panel cover 300, including the framing 340, has a length 200 of approximately 7 feet 5½ inches and width 202 of approximately 8 feet 3 inches. As shown in FIG. 2, the width 202 includes corner framing (204 and 212) of approximately 9¾ inches, doorways (206 and 210) of approximately 36 inches, and a central framing 208 of approximately 7½ inches. FIGS. 6B–D show that the preferred height 216 of the ACU 10 is approximately 7 feet and 4 inches. The clearance 214 between the top panel cover 300 and the ceiling 320 is preferably at least 2 feet and 0 inches. It may also be noted that the floor for accommodating the ACU is preferably level within approximately +/–¼ inches. The ACU may be positioned so that the face of the building is flush with the front of the ACU, flush with the back of the ACU. It should be noted that these dimensions are meant to be exemplary and may be adapted to correspond with specific needs of a user. In passing, it is noted that regulations relating to disabled persons, using wheelchairs, require that the length of the entrance chamber 12 and exit chamber 14 be at least seven (7) feet, and that the width of the chambers be 36 inches.

FIGS. 6A–6D also show one embodiment of the framing system 340 of the ACU 10. The framing system 340 supports several glass or high strength transparent plastic panels 310. Both the framing system 340 and the glass panels 310 are made of materials which are preferably extremely strong and bullet proof glass or plastic to allow complete visual access to the ACU 10. The access chamber is formed of aluminum framing along all the sides of the box-shaped chamber. The framing secures the glass and plastic panels in the sides and doors such that the inside of the chamber is almost completely visible from the outside. Using the same material for the side walls and doors significantly reduces the cost of the access control chamber and makes it easier to manufacture and install. An assemblyman needs only a basic knowledge of assembling the frame members with the glass panels secured within the framing.

FIG. 6B shows a side view of the access chamber in which the sides are formed of two pieces of glass and separated by a vertical frame member. Using two sections instead of one large piece of glass is beneficial, since the smaller sections are lighter than the larger one which allows for manual installation of the glass. No power equipment is required as would be for a piece over 8 feet long and 7 feet high. Also, the middle frame section provides more structural support to the entire access chamber than would the single glass piece as shown in the Urbano patent. Also, if the glass was to be broken due to a fired bullet, only the one damaged glass panel would need to be replaced instead of the whole side section as would be required in the Urbano patent.

Figure 7:
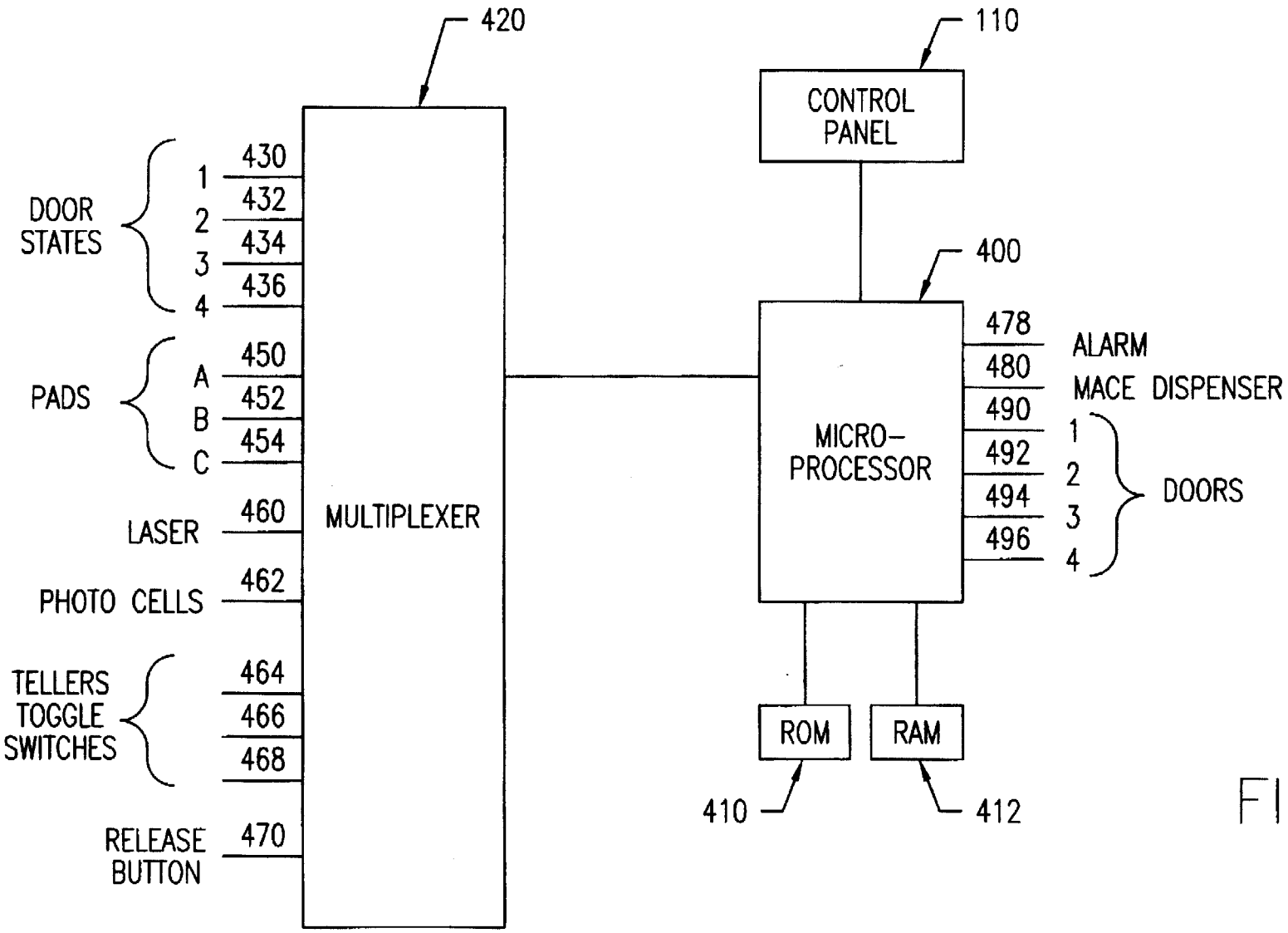
FIG. 7 is a block circuit diagram of one embodiment showing the electronic connections of the access control system.

FIG. 7 is a block circuit diagram of a simplified embodiment of the electronic connections of the present invention. The system would be controlled by a microprocessor 400 which includes or is attached to memory such as read-only memory (ROM) 410, and Random Access Memory (RAM) 412. The microprocessor 400 would receive input, generally supplied through a multiplexer 420, from various elements of the vestibule. This input could include, but is not limited to the input circuits providing the status of the control panel 110, each of the doors (430, 432, 434, and 436), each of the mats (450, 452, and 454), the laser or sensor system 460, the photo cells 462, the tellers toggle switches (464, 466, and 468), and a wireless door release button 470. The microprocessor controls elements of the system including, but not limited to the alarm 478, a MACE dispenser 480, and each door (490, 492, 494, and 496) in accordance with the operational diagrams of FIGS. 8A through 8J.

FIG. 8H is a block diagram of the operation of the entrance chamber camera system interface which may be included in the present invention. More specifically, a closed circuit TV system may work in conjunction with the vestibule to provide a record of people that activate the metal detector 60. The camera system (as shown schematically in FIG. 1) may include a camera 230 installed at the entrance chamber 12, a time lapse security video recorder 232, and a monitor 234. The camera system is activated by the metal detector 60 or by the control panel 110. If a signal is sent from the control panel or metal detector 60 as indicated by block 553, the time lapse security VCR per block 552 requests and receives an image from the camera as indicated by block 551. The time lapse provides the image to the video monitor as indicated by block 554.

FIG. 8-I is a block diagram setting forth the mode of operation of the entrance chamber metal detector system as it interfaces with the camera system. A person enters the entrance chamber 12 as indicated at block 555 and proceeds through the metal detector, see step 556. When the metal detector is activated or alarmed as shown at block 570, it sends a signal to the control panel 110 as shown at block 580. The control panel 110 sends a signal to activate the time lapse security video recorder 232 for 15 seconds as shown at 590 and records the person for that period. If no metal is detected, then there is no alarm as indicated by block 560 and the video recorder does not make a recording as indicated by block 561.

The present invention is preferably adapted for use with handicapped persons. For example, as shown in FIG. 6C, the ACU 10 is provided with a handicapped assistance push button 240 outside No. 1 door 20 is activated as indicated by block 562, an audible or visual signal is activated to advise the operator at the control panel that somebody needs assistance going through the entrance chamber 12, see block 564. The operator then, using the control panel, will assist the person. The block 563 indicates that the power supply 160 may provide the signal triggered by actuation of the switch 240. The operator may normally release the No. 1 and No. 2 doors if the handicapped person is recognized. If desired, the No. 1 and No. 2 doors (as well as the exit doors) may be powered, if desired, and may be operated by push-bars on the doors, if other conditions are met.

The program steps or modes of operation are set forth in FIGS. 8A through 8J are implemented by the microprocessor 400 of FIG. 7 under the control of the Read Only Memory, or ROM 410 by which the program steps are implemented.

By way of example only, and not by way of limitations, the following companies may supply appropriate parts of the present invention. Securitron Magnalock Corp (550 Vista Blvd., Sparks, Nev. 89434, (702)355-5625) produces a preferred embodiment of a Power Supply (3 amp., BPS - 24-3), Magnetic Lock (1,200 pds, M62S-24), Magnetic Lock (800 and, M32S-24), Touch Sense Bars (TSB-1), Control Panel (LCP-8-42), Second Operator Button (PB2, Nova, Custom Deck), and ADA Assistance Push Button (PB-2). EG&G Astrophysics Research Corporation (4031 Via Oro Avenue, Long Beach, Calif. 90810,, Phone (800) 869-1411) produces a preferred embodiment of the Metal Detector Electronic Components (01-0206--01/Sentries AT Telem Kit). Viracon (800 Park Drive Owatonna, Minn. 55060, Phone: (800)-553-2080) produces preferred embodiments of Bullet Resistant Glass Level 1 (Guard Vue 100) and Bullet Resistant Glass Level 2 (Guard Vue 300). Lanson Industries (PO Box 906, S82 W18717, Gemini Drive Muskego, Wis. 53150, Phone: (414) 679-0045) produces a preferred embodiment of the Contact Metal Plates Rubber Mats (146575). L.C.N. Closers (P.O. Box 100 Princeton Ill. 62356-0100, Phone: (815) 875-3311) produces preferred embodiments of Left Hand Concealed Door Closer (2033 Closer CYL-SR1 LH) and Right Hand Concealed Door Closer (2033 Closer CYL-SRT RH). Grand Central Engineering are distributors for Watec America Corporation, BYRR, Rainbow Lenses, and Sanyo (11181 S Rogers Circle, Suite 21, Boca Raton, Fla. 33487, Phone: (407 994-0881) and therefore can provide preferred embodiments of a Watec Video Camera (WAT-501EX), Time Lapse Video Recorder (GYRR TLC 1824), Rainbow Camera Lens (H3.5 mm, 1:1.6 E-11), Sanyo Video Monitor (VM 5009). The William L. Bonnell Co. (25 Bonnell Street, Newman, Ga. 30263, Phone: (404) 253-2020) produces preferred embodiments of the Access Control Unit Aluminum Framing). Optex (U.S.), Inc. (365 Van Ness Way, Suite 510, Torrance, Calif. 90501, Phone: (310) 212-7271) produces a preferred embodiment of a Photocell Safety Beam Switch (OS-2C). Interactive Light, Inc. (Phone: (310) 268-2718) produces a preferred embodiment of a Infrared Detection System. These parts are meant to be exemplary and are not intended to limit the scope of the invention.

In conclusion, it is to be understood that the present invention is not to be limited to that precisely as described herein and as shown in the accompanying drawings. More specifically, the invention could be adapted to provide security for any secure area such as a bank vault, jewelry store, prison, or other security buildings. Additional handles and push bars could be added or the manual pull handle may be replaced with an electrically activated automatic system for opening the doors when access or egress is permitted. It is further noted that the functions as shown in FIGS. 8A through 8J may readily be implemented using hand wired relay or transistor circuits instead of the microprocessor implementation described herein. Also, instead of floor contact pads, other detection arrangements may be provided to determine the location of persons within the entrance and exit chambers. Further, the entrance chamber as disclosed herein may be employed to control access to the secured area, and other exit-only arrangements may be provided, for example, of the general type used is subway exits using a one-way revolving door type assembly having interlocking bars to prevent entry. Accordingly, the present invention is not limited to the arrangements precisely as shown and described herein.

What is claimed is:

1. An access control vestibule comprising;

an aluminum frame having a rectangular shape and forming a front side, a rear side, a ceiling, a side wall and a floor;

an entrance door and an exit door;

an entrance chamber formed between the entrance door and the exit door;

the two doors having an aluminum frame and a transparent ballistic glass panel mounted therein;

the two doors each being a single, manually operated door and swingable towards the outside of the entrance chamber;

a magnetic lock associated with each of the entrance door and exit door;

a metal detector located at a mid-point of the entrance chamber;

the aluminum frame on the side wall including a vertical frame member positioned at a mid-point along the side wall;

the side wall having two pieces of transparent ballistic glass panels mounted therein; and, control means to prevent both doors from being unlocked at the same time, and to prevent the exit door from being unlocked when the metal detector detects a metal object within the entrance chamber.

2. The access control vestibule of claim 1, and further comprising;

a 24 volt DC power supply to supply power to the control means; and, the magnetic locks and the metal detector operating at 24 volts DC.

3. The access control vestibule of claim 2, and further comprising;

the control means includes means to maintain power to the metal detector when the vestibule is shut off.

4. The access control vestibule of claim 2, and further comprising;

the control means includes a 24 volt DC battery backup.

5. The access control vestibule of claim 1, and further comprising;

the control means including a control panel;

an exit door release button mounted on the control panel;

a wireless remote control unit having an exit door release button thereon;

whereby an operator can unlock the exit door by activating either the release button on the control panel or the wireless remote control unit.

6. The access control vestibule of claim 1, and further comprising;

a touch sensitive pressure pad located on the floor of the entrance chamber;

the frame on the side wall including a horizontally extending frame member extending along the floor and supporting the glass panels;

signal transmission means to transmit a signal along the horizontally extending frame member; and, the control means including means to detect if the signal transmitted by the signal transmission means is interrupted.

7. The access control vestibule of claim 6, and further comprising;

the signal transmission means including a photocell.

8. The access control vestibule of claim 1, and further comprising;

object detection means to detect if an object is on the floor of the entrance chamber; and, the control means includes means to prevent the exit door from being unlocked when the object detection means detects an object on the floor of the entrance chamber.

9. The access control vestibule of claim 8, and further comprising;

the object detection means includes a laser or infrared sensor.

10. The access control vestibule of claim 1, and further comprising;

floor straddling detection means operatively associated with the control means to detect if an object is located on the frame along the floor.

11. The access control vestibule of claim 10, and further comprising;

the floor straddling detection means includes a photocell which extends a beam of light along the frame such that the beam of light is interrupted if the object is positioned along the floor framing.

12. The access control vestibule of claim 11, and further comprising;

wherein the object is a person straddling the floor detection means.

13. The access control vestibule of claim 1, and further comprising;

object detection means arranged along the floor of the entrance chamber to detect if an object other than a person is located on the floor.

14. The access control vestibule of claim 13, and further comprising;

wherein the object is a weapon.

15. The access control vestibule of claim 14, and further comprising;

wherein the object detection means is one of a laser or infrared sensor.

16. The access control vestibule of claim 1, and further comprising;

an exit chamber including an entrance door and an exit door, the exit chamber being arranged alongside the entrance chamber;

whereby the entrance chamber allow entrance into a building, and the exit chamber allows exit from the building.

17. The access control vestibule of claim 10, and further comprising;

the doors of the exit chamber swing towards the outside of the building.

18. An access control vestibule comprising;

a main frame forming a front side, a rear side, and a wall side, the main frame being made of aluminum;

a front door frame mounted to the front side of the main frame, the front door frame being made of aluminum;

a front door having an aluminum frame and a transparent ballistic glass panel, the front door being swingably mounted within the front door frame such that the door swings outward;

a rear door frame mounted to the rear side of the main frame, the rear door frame being made of aluminum, a rear door having an aluminum frame and a transparent ballistic glass panel, the rear door being swingably mounted within the rear door frame such that the door swings outward;

both doors being manually operated;

an entrance chamber formed between the front door and the rear door;

a side wall mounted to the main frame along the wall side, the side wall including two panels of transparent ballistic glass separated by a vertical frame member, the two panels having the same size and shape;

a pair of magnetic locks, each mounted to the respective door frames;

a metal detector located in the entrance chamber and mid-point between the two doors; and, control means to prevent both doors from being unlocked at the same time, and to prevent the rear door from being unlocked when the metal detector detects a metal object within the entrance chamber.

19. The access control vestibule of claim 18, and further comprising;

a second front door frame mounted to the front side of the main frame, the second front door frame being made of aluminum;

a second front door having an aluminum frame and a transparent ballistic glass panel, the second front door being swingably mounted within the second front door frame such that the door swings outward;

a second rear door frame mounted to the rear side of the main frame, the second rear door frame being made of aluminum;

a second rear door having an aluminum frame and a transparent ballistic glass panel, the second rear door being swingably mounted within the second rear door frame such that the door swings toward the second front door;

both of the second doors being manually operated; and an exit chamber formed between the second front door and the second rear door.

20. The access control vestibule of claim 19, and further comprising;

a common side wall separating the entrance chamber and the exit chamber, the common side wall having a pair of transparent ballistic glass panels separated by a vertical frame member, the panels having the same size and shape.

21. The access control vestibule of claim 19, and further comprising;

each of the entrance chamber and exit chamber includes a pair of side walls, each side wall having two panels of transparent ballistic glass separated by a vertical frame member, the panels having the same size and shape.

22. An access control vestibule comprising;

a main frame having a rectangular shape and forming a front side, a rear side, and a wall side, the main frame being made of a metal;

a single entrance door mounted to the front side of the main frame, the entrance door having a metal frame and a transparent ballistic glass panel mounted therein, the entrance door being manually operated and swingable towards the outside of the vestibule;

a single exit door mounted to the rear side of the main frame, the exit door having a metal frame and a transparent ballistic glass panel mounted therein, the exit door being manually operated and swingable towards the outside of the vestibule;

an entrance chamber formed between the entrance door and the exit door;

a transparent ballistic glass panel mounted along the wall side of the main frame;

lock means associated with each of the two doors and operable to lock the respective door;

a metal detector located within the entrance chamber and spaced midway between the two doors; and, control means to prevent both doors from being unlocked at the same time, and to prevent the exit door from being unlocked when the metal detector detects a metal object within the entrance chamber.

23. The access control vestibule of claim 22, and further comprising;

a 24 volt DC power supply to supply power to the control means; and, the locks means and the metal detector operating at 24 volts DC.

24. The access control vestibule of claim 22, and further comprising;

the control means includes means to maintain power to the metal detector when the vestibule is shut off.

25. The access control vestibule of claim 23, and further comprising;

the control means includes a 24 volt DC battery backup.

26. The access control vestibule of claim 22, and further comprising;

the control means including a control panel;

an exit door release button mounted on the control panel;

wireless remote control unit having an exit door release button thereon;

whereby an operator can unlock the exit door by activating either the release button on the control panel or the wireless remote control unit.

27. The access control vestibule of claim 22, and further comprising;

a touch sensitive pressure pad located on a floor of the entrance chamber;

the frame on the wall side including a horizontally extending frame member extending along the floor and supporting the glass panel;

signal transmission means to transmit a signal along the horizontally extending frame member; and, the control means including means to detect if the signal transmitted by the signal transmission means is interrupted.

28. The access control vestibule of claim 27, and further comprising;

the signal transmission means is a photocell, and the control means detects if a person is straddling floor pads by standing on the frame along the floor.

29. The access control vestibule of claim 22, and further comprising;

the entrance chamber having an entrance side and an exit side;

a touch sensitive floor pad located on each of the entrance side and exit side of the entrance chamber;

the control means including means to detect if a person is standing on one of the touch pads; and, means to prevent the exit door from being unlocked when the control means detects that a person or persons is/are standing on both touch pads.

30. An access control vestibule, comprising;

an aluminum frame having a rectangular shape;

an entrance door frame and an exit door frame each made of aluminum;

a transparent ballistic resistant glass panel mounted in the frame and forming a side wall section of the vestibule;

a transparent ballistic resistant glass panel mounted in each of the door frames and forming an entrance door and an exit door;

the entrance door and the exit door both being manually operated, consist of a single swinging door, and swingable towards the outside of the vestibule;

a magnetic lock associated with each of the doors;

a metal detector located between the two doors; and, control means to prevent both doors from being unlocked at the same time, and to prevent the exit door from being unlocked when the metal detector detects a metal object.

31. The access control vestibule of claim 30, and further comprising;

a 24 volt DC power supply to supply power to the control means, the metal detector, and the magnetic locks.

32. The access control vestibule of claim 31, and further comprising;

the control means includes a 24 volt DC battery backup.

* * * * *